US005628841A

United States Patent [19]

Inoue et al.

[11] Patent Number: 5,628,841

[45] Date of Patent: *May 13, 1997

[54] THIN FE-NI ALLOY SHEET FOR SHADOW MASK

[75] Inventors: Tadashi Inoue; Kiyoshi Tsuru; Tomoyoshi Okita; Michihito Hiasa, all of Kawasaki-ku, Japan

[73] Assignee: NKK Corporation, Tokyo, Japan

[ * ] Notice: The term of this patent shall not extend beyond the expiration date of Pat. No. 5,308,723.

[21] Appl. No.: 184,840

[22] Filed: Jan. 21, 1994

Related U.S. Application Data

[62] Division of Ser. No. 7,755, Jan. 22, 1993, Pat. No. 5,456, 771.

[30] Foreign Application Priority Data

| | | | |
|---|---|---|---|
| Jan. 24, 1992 | [JP] | Japan | 4-032941 |
| Feb. 28, 1992 | [JP] | Japan | 4-078506 |
| Sep. 24, 1992 | [JP] | Japan | 4-279542 |

[51] Int. Cl.[6] ..... H01F 1/04

[52] U.S. Cl. ..... 148/310; 148/336; 148/120; 420/94

[58] Field of Search ..... 148/310, 336, 148/120; 420/94

[56] References Cited

U.S. PATENT DOCUMENTS

| | | | |
|---|---|---|---|
| 4,724,012 | 2/1988 | Inaba et al. | 148/2 |
| 4,751,424 | 6/1988 | Tong | 313/402 |
| 5,127,965 | 7/1992 | Inoue et al. | 148/500 |
| 5,158,624 | 10/1992 | Okiyama et al. | 148/310 |
| 5,207,844 | 5/1993 | Watanabe et al. | 148/546 |
| 5,234,512 | 8/1993 | Inoue et al. | 148/541 |
| 5,234,513 | 8/1993 | Inoue et al. | 148/541 |
| 5,308,723 | 5/1994 | Inoue et al. | 430/23 |

FOREIGN PATENT DOCUMENTS

| | | |
|---|---|---|
| 0104453 | 4/1984 | European Pat. Off. . |
| 0174196 | 3/1986 | European Pat. Off. . |
| 0552800 | 7/1993 | European Pat. Off. . |
| 0561120 | 9/1993 | European Pat. Off. . |
| 2664908 | 1/1992 | France . |

(List continued on next page.)

OTHER PUBLICATIONS

Chemical Abstracts, p. 249, No. 133956d of JP–A–60 251, vol. 104, No. 16, Apr. 21, 1986.

(List continued on next page.)

*Primary Examiner*—John Sheehan

*Attorney, Agent, or Firm*—Frishauf, Holtz, Goodman, Langer & Chick, P.C.

[57] ABSTRACT

A thin Fe—Ni alloy sheet for shadow mask consists essentially of Ni of 34 to 38 wt. %, Si of 0.05 wt. % or less, B of 0.0005 wt. % or less, O of 0.002 wt. % or less and N of 0.0015% or less, the balance being Fe and inevitable impurities; said alloy sheet after annealing before press-forming having 0.2% proof stress of 28.5 kgf/mm$^2$ or less; and a degree of {211} plane on a surface of said alloy sheet being 16% or less. And further modified similar alloy sheets are also provided.

Further, a method for producing a thin Fe—Ni alloy sheet for shadow mask comprises the steps of: (a) hot-rolling of a slab into a hot-rolled alloy strip; (b) hot-rolled sheet annealing of the hot-rolled strip at 910 to 990° C.; (c) cold-rolling of the annealed hot-rolled strip into a cold-rolled strip; (d) recrystallization annealing of the cold-rolled strip; (e) finish cold-rolling of the recrystallization annealed strip at a finish cold reduction ratio in response to austenite grain size D(Dμm) yieleded by the recrystallization annealing, the finish cold reducration ratio(R) being within a region enclosed by a range of R of 16 to 75 and a range of D of $6.38D-133.9 \leqq R \leqq 6.38D-51.0$ and (f) annealing of the finish cold-rolled strip on conditions of a temperature of 720° to 790° C., a time of 2 to 40 min. and $T \geqq -53.8 \log t + 806$, where T(°C.) is the temperature of the annealing. And further modified similar methods are also provided.

9 Claims, 13 Drawing Sheets

FOREIGN PATENT DOCUMENTS

| | | | |
|---|---|---|---|
| 2668498 | 4/1992 | France . | |
| 3636815 | 5/1987 | Germany . | |
| 3642205 | 1/1988 | Germany . | |
| 59-59861 | 4/1984 | Japan . | |
| 61-19737 | 1/1986 | Japan | 148/336 |
| 61-113747 | 5/1986 | Japan . | |
| 63-259054 | 10/1988 | Japan . | |
| 64-52024 | 2/1989 | Japan . | |
| 3-197645 | 8/1991 | Japan . | |
| 3-267320 | 11/1991 | Japan . | |
| WO91/12345 | 8/1991 | WIPO . | |

OTHER PUBLICATIONS

Database WPIL, Week 8732, Derwent Publications Ltd., London, GB; AN 87–224995 & Abstract of JP–A–62 149 851.

Database WPIL, Week 8615, Derwent Publications Ltd., London, GB; AN 86–098295 & Abstract of JP–A–61 044 126.

Database WPIL, Week 8610, Derwent Publications Ltd., London, GB; AN 86–066609 of JP–A–61 019 737 (1986).

Patent Abstracts of Japan, vol. 10, No. 296 (C–377), Oct. 8, 1986 of JP 61–113747 (Nippon Mining Co., Ltd.), May 31, 1986.

Patent Abstracts of Japan, vol. 15, No. 461 (C–0887), Nov. 22, 1991 of JP 3–197645 (Nippon Mining Co., Ltd.), Aug. 29, 1991.

Patent Abstracts of Japan, vol. 13, No. 69 (C–569), Feb. 16, 1989 of JP 63–259054 (Nippon Mining Co., Ltd.), Oct. 26, 1988.

Patent Abstracts of Japan, vol. 15, No. 461 (C–0887), Nov. 22, 1991 of JP 3–197646 (Nippon Mining Co., Ltd.), Aug. 29, 1991.

Patent Abstracts of Japan, vol. 15, No. 92 (C–0811), Mar. 6, 1991 of JP 2–305941 (Toyo Kohan Co., Ltd.), Dec. 19, 1990.

Patent Abstracts of Japan, vol. 10, No. 196 (C–377), Oct. 8, 1986 of JP 61–113746 (Nippon Mining Co., Ltd.), May 31, 1986.

FIG. 5A
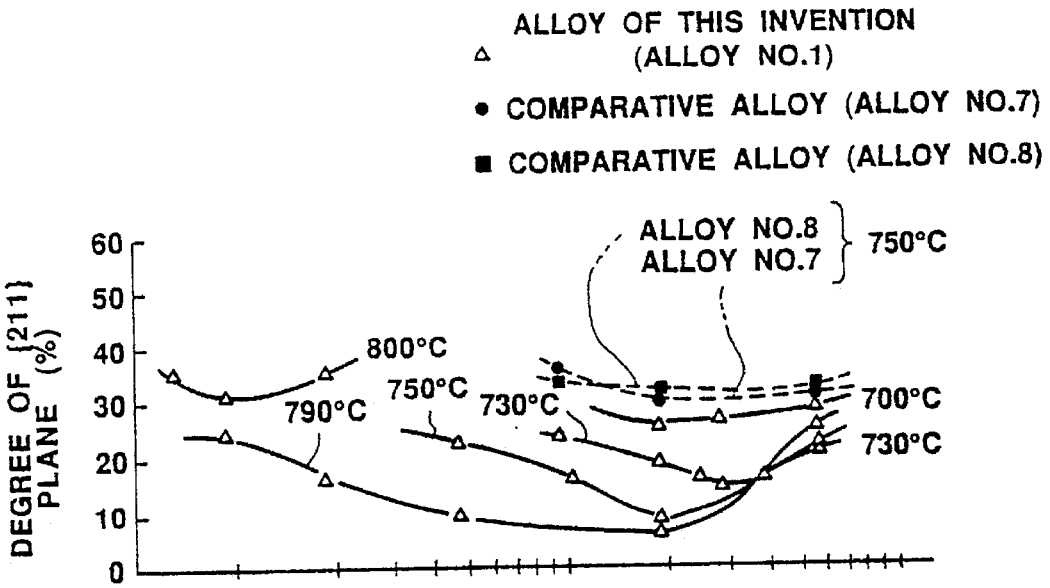
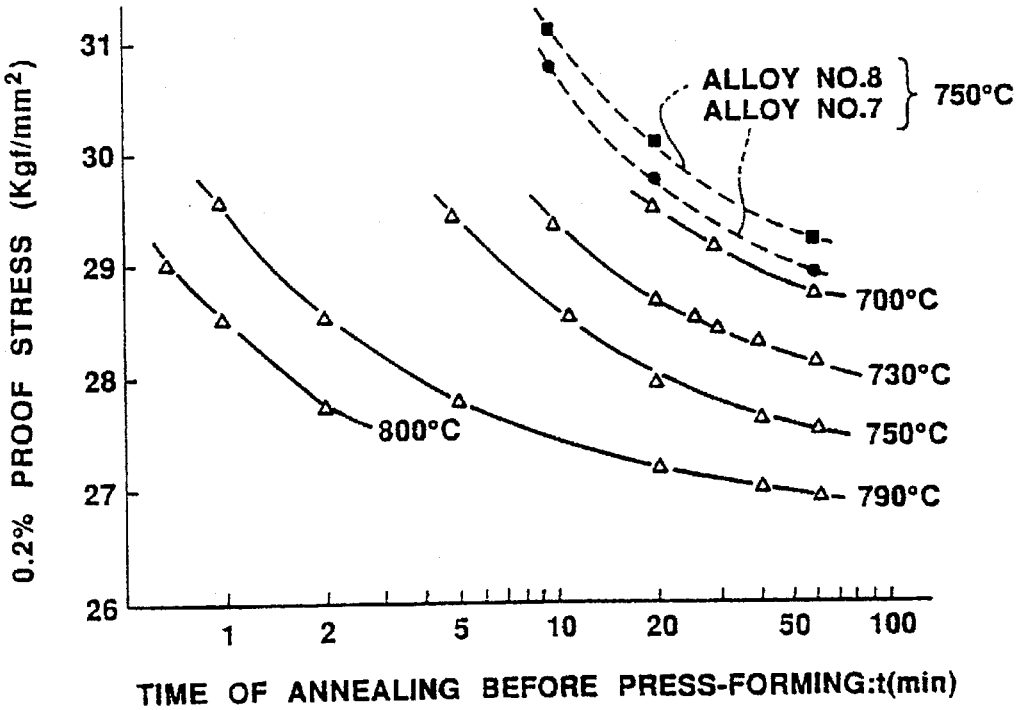
FIG. 5B

THIN FE-NI ALLOY SHEET FOR SHADOW MASK

This is a division of application Ser. No. 08/007,755 filed Jan. 22, 1993 now U.S. Pat. No. 5,456,771.

BACKGROUND OF THE INVENTION

1. Field of the Invention

This invention relates to a thin Fe—Ni alloy sheet for shadow mask having high press-working performance and method for manufacturing thereof and in particular to a thin Fe—Ni alloy sheet for shadow mask suitable for color cathode ray tube and method for manufacturing thereof.

2. Description of the Related Art

Recent up-grading trend of color television toward high definition TV has employed Fe—Ni alloy containing 34–38 wt. % of Ni as the alloy for shadow mask to cope with color-phase shift. Compared with low carbon steel which has long been used as a shadow mask material, conventional Fe—Ni alloy has a considerably low thermal expansion coefficient. Accordingly, a shadow mask made of conventional Fe—Ni alloy raises no problem of color-phase shift coming from the thermal expansion of shadow mask even when electron beam heats the shadow mask.

Common practice of making thin alloy sheet for a shadow mask includes the following steps. An alloy ingot is prepared by continuous casting process or ingot-making process. The alloy ingot is subjected to slabbing, hot-rolling, cold-rolling, and annealing to form a thin alloy sheet.

The alloy sheet is then processed usually in the following steps to form a shadow mask. Photo-etching forms passage-hole for electron beam on the thin alloy sheet for a shadow mask. The "passage-hole for electron beam" is hereinafter referred to as "hole". The thin alloy sheet for a shadow mask perforated by etching is hereinafter referred to as "flat mask". The flat mask is subjected to annealing. The annealed flat mask is pressed into a curved shape of cathode ray tube. The press-formed flat mask is assembled to a shadow mask which is then subjected to blackening treatment.

However, the shadow mask material of conventional Fe—Ni alloy has higher strength than conventional low carbon steel, which raises a problem of press-forming performance after perforation by etching. Softening is a means to solve the problem, where the crystal grain size is enlarged to a coarse one by conducting softening-annealing at 800° C. or higher temperature. After the softening-annealing, warm-press is applied to carry out spheroidal forming. The temperature of 800° C. is, however, in a high temperature region. Accordingly, from the viewpoint of work efficiency and economy, the development of manufacturing method to obtain such a low strength by a lower temperature softening-annealing has been awaited.

The prior art (A) is described in JP-A-H3-267320 (the term "JP-A-" referred to herein simplifies "unexamined Japanese patent publication"), where a method to decrease the strength of shadow mask material to a level preferred for press-forming is provided. According to the prior art (A), the recrystallization annealing is carried after cold-rolling. The temperature of recrystallization annealing is below 800° C., and the embodiment of this invention adopts the operation at 730° C. for 60 min. After the recrystallization annealing, the finish cold-rolling is conducted within a reduction ratio range of 5–20%. The prior art (A) produces a shadow mask having good press-forming performance giving 9.5 kgf/mm$^2$ of proof stress at 200° C.

Although the prior art (A) reduces the strength to a preferable level for press-forming by selecting the annealing condition of 730° C. and 60 min., it does not satisfy the quality required to perform a favorable warm press-forming. Shadow masks prepared by the prior art (A) were found to gall the die and to generate cracks at the edge of shadow masks.

Nevertheless, cathode ray tube manufacturers try to carry out the annealing before press-forming at 730° C. for 40 min. or shorter duration aiming to improve work efficiency and economy. In some cases, the annealing as short as 2 min. is applied. However, if such an annealing condition is applied to the prior art (A), the galling during press-forming becomes severe and the crack on shadow mask increases to raise serious quality problem.

The prior art (B) is introduced in JP-A-S64-52024 where a method to decrease intra-plane a nisotropy, a mechanical property of material, is provided. In this method, at least two cycles of the cold-rolling and recrystallization annealing are repeated followed by the cold-rolling to increase hardness. A shadow mask base sheet having a low intra-plane anisotropy of elastic coefficient is obtained by selecting the reduction ratio of cold-rolling immediately before the final recrystallization within a range of 40–80%. When the base sheet is etched, annealed, and press-formed, it gives an excellent uniform deformation during press-forming resulting in a small deformation of etched-hole and free from irregular gloss and stringer defect.

According to the prior art (B), the intra-plane anisotropy is sufficiently small and the generation of penetration irregularity is at a low level, which raises no quality problem. Still, the prior art (B) induces cracks at the edge of shadow mask during press-forming.

Present color televisions require severer quality specification on color-phase shift because the color picture tubes direct to a brighter and more flat face than ever. The cathode ray tubes using the shadow masks prepared by the prior art (A) and the prior art (B) give partial color-phase shift under electron beam irradiation.

SUMMARY OF THE INVENTION

The object of this invention is to provide a thin Fe—Ni alloy sheet for shadow mask having high press-forming performance and method for manufacturing thereof. To achieve the object, this invention provides a thin Fe—Ni alloy sheet for shadow mask consisting essentially of Ni of 34 to 38 wt. %, Si of 0.05 wt. % or less, B of 0.0005 wt. % or less, O of 0.002 wt. % or less and N of 0.0015% or less, the balance being Fe and inevitable impurities;

said alloy sheet after annealing before press-forming having 0.2% proof stress of 28.5 kgf/mm$^2$ or less; and a degree of {211} plane on a surface of said alloy sheet being 16% or less.

This invention also provides a method for manufacturing thin Fe—Ni alloy sheet for shadow mask comprising the steps of:

(a) hot-rolling a slab consisting essentially of Ni of 34 to 38 wt. %, Si of 0.05 wt. % or less, B of 0.0005 wt. % or less, O of 0.002 wt. % or less and N of 0.0015% or less, the balance being Fe and inevitable impurities into a hot-rolled alloy strip;

(b) annealing the hot-rolled strip at 910° to 990° C.;

(c) cold-rolling the annealed hot-rolled strip into a cold-rolled strip:

(d) recrystallization annealing step of annealling the cold-rolled strip;

(e) finish cold-rolling the annealed strip at a finish cold reduction ratio in response to austenite grain size D(Dμm) yielded by the recrystallization annealing, the finish cold reduction ratio (R) being within a region enclosed by a range of R of 16 to 75 and a range of D of $6.38D-133.9 \leqq R \leqq 6.38D-51.0$ where austenite grain D (μm) is represented on abscissa and finish reduction ratio (R) on ordinate in a D-R diagram; and (f) annealing the finish cold-rolled strip on conditions of a temperature of 720° to 790° C., a time of 2 to 40 min. and $T \geqq -53.8 \log t+806$, where T(°C.) is the temperature of the annealing.

This invention further provides a thin Fe—Ni alloy sheet for shadow mask consisting essentially of Ni of 34 to 38 wt. %, Si of 0.05 wt. % or less, B of 0.0005 wt. % or less, O of 0.002 wt. % or less and N of 0.0015% or less, the balance being Fe and inevitable impurities;

an average austenite grain size D of an alloy sheet after annealing before press-forming ranging from 15 to 45 μm;

a degree of mixed grain for austenite grains of 50% or less, said degree of mixed grain for austenite grains being represented by an equation of $(|0.5\times Dmax-D|/D)\times 100(\%)$; and the degree of {331} plane on a surface of said alloy sheet being 35% or less, the degree of {220} plane 16% or less and the degree of {211} plane 20% or less, where the Dmax is a maximum austenite crystal grain size.

This invention still further provides a method for manufacturing thin Fe—Ni alloy sheet for shadow mask comprising the steps of:

(a) hot-rolling a slab consisting essentially of Ni of 34 to 38 wt. %, Si of 0.05 wt. % or less, B of 0.0005 wt. % or less, O of 0.002 wt. % or less and N of 0.0015% or less, the balance being Fe and inevitable impurities into a hot-rolled strip;

(b) annealing the hot-rolled strip at 810° to 890° C.;

(c) cold-rolling the annealed hot-rolled strip at a reduction ratio of 81 to 94% into a cold-rolled strip;

(d) recrystallization annealing step of annealing the cold-rolled strip;

(e) finish cold-rolling the recrystallization annealed strip at a finish cold reduction ratio in response to austenite grain size D (μm) yieleded by the recrystallization annealing, the finish cold reduction ratio is from 16 to 29%.

(f) strain relief annealing step of annealing the finish cold-rolled strip; and (g) annealing before press-forming step of annealing the strain relief annealed strip on conditions of a temperature of 740° to 900° C., a time of 2 to 40 min. and $T \geqq -123 \log t+937$, where T is the temperature(°C.) of the annealing before press-forming.

This invention further provides a thin Fe—Ni alloy sheet for shadow mask consisting of essentially of Ni of 34 to 38 wt. %, Si of 0.05 wt. % or less, B of 0.001 wt. % or less, O of 0.003 wt. % or less and N of 0.0015% or less, the balance being Fe and inevitable impurities;

an average austenite grain size Dav of an alloy sheet before annealing before press-forming ranging from 10.5 to 15 μm;

a ratio of a maximum to a minimum size of austenite grains of said alloy sheet being is 1 to 15;

Vickers hardness(Hv) of said alloy sheet which ranges 165 to 220 and satisfies a condition of $10\times Dav+80 \geqq (Hv) \geqq 10\times Dav+50$; and the degree of {111} plane on a surface of said alloy sheet being 14% or less, the degree of {100} plane 5 to 75%, the degree of {110} plane 5 to 40%, the degree of {311} plane 20% or less, the degree of {331} plane 20% or less, the degree of {210} plane 20% or less and the degree of {211} plane 20% or less.

In the thin alloy said Ni can range from 35 to 37 wt. %, said Si from 0.001 to 0.05 wt. %, said O from 0.0001 to 0.002 wt. % and N from 0.0001 to 0.0015 wt. %.

In the thin alloy sheet said ratio or a maximum to a minimum size of austenite grains can be from 1 to 10.

In the thin alloy sheet said degree of {100} plane can be 8 to 46%.

BRIEF DESCRIPTION OF THE DRAWINGS

FIGS. 5A and 5B shows the relation among 0.2% proof stress after the annealing before press-forming, degree of {211} plane, and the condition of annealing before press-forming, being described in the preferred embodiment-1.

DESCRIPTION OF THE PREFERRED EMBODIMENT

Preferred embodiment-1

Figure 1:
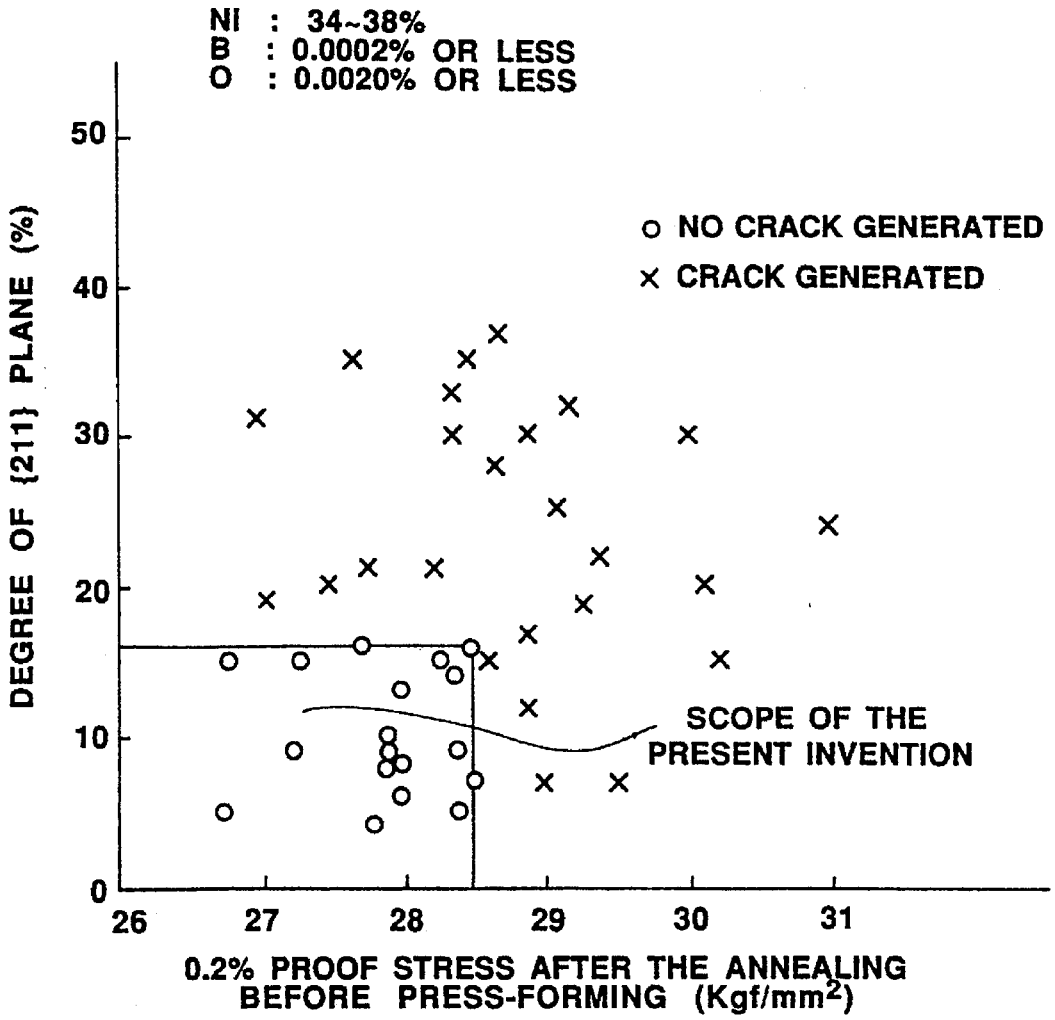
FIG. 1 shows the relation among crack generation during press-forming, degree of {211} plane, and 0.2% proof stress after the annealing before press-forming, being described in the preferred embodiment-1.

According to this invention, a desired quality of press-formed thin Fe—Ni alloy sheet for a shadow mask is obtained by adjusting chemical composition, 0.2% proof stress, and crystal orientation within a specified range. In concrete terms, the presence of B and O within a specified range enhances the growth of crystal grains during the annealing before press-forming to coarse grains, which results in a low yield strength. In addition, the presence of Si and N within a specified range suppresses the galling to die and improves the fitness to die. Furthermore, the crack generation during press-forming is suppressed by adjusting the degree of {211} plane of the thin alloy sheet within a specified range after the annealing before press-forming.

The method of this invention conducts the annealing of hot-rolled strip at a specified temperature before cold-rolling, and selects adequate reduction ratio of the finish cold-rolling depending on the austenite grain size before the finish cold-rolling. Also the method of this invention adjusts the 0.2% proof stress and the degree of {211} plane of the thin alloy sheet after the annealing before press-forming within each specific range.

The invention is described to a greater detail in the following beginning with the reasons to limit the range of chemical composition, 0.2% proof stress after the annealing before press-forming, and degree of crystal plane of thin Fe—Ni alloy sheet for shadow mask.

This invention requests a specific range of yield strength in order to improve the shape fixability during press-forming and to suppress the crack generation on alloy sheet. The yield strength is represented by 0.2% proof stress at the ambient temperature. When the warm press-working is applied, the upper limit of 0.2% proof stress is defined as 28.5 kgf/mm$^2$. Lower value of 0.2% proof stress than 28.5 kgf/mm$^2$ further improves the shape fixability.

According to this invention, two conditions are necessary to enhance the growth of crystal grains during the annealing before press-forming. The one condition is to control the content of O and B at or below each specified value. The other condition is to control the content of Si and Ni at or below each specified value to improve the fitness to die during press-forming.

(1) Nickel

To prevent color-phase shift, the thin Fe—Ni alloy sheet for shadow mask is necessary to have the upper limit of average thermal expansion coefficient at approximately $2.0\times 10^{-6}$/°C. in a temperature range of 30°–100° C. The average thermal expansion coefficient depends on the content of Ni in the thin alloy sheet. The Ni content which satisfies the above limitation of average thermal expansion coefficient is in a range of 34–38 wt. %. Consequently, the preferred Ni content is in a range of 34–38 wt. %.

(2) Oxygen

Oxygen is one of the impurities unavoidably enter into the alloy. Increased content of O increases the non-metallic oxide inclusion within the alloy, which inclusion suppresses the growth of crystal grains during the annealing before press-forming, particularly under the condition of 720°–790° C. and 40 min. or shorter annealing. If the content of O exceeds 0.002%, then the inclusion caused by O considerably suppresses the growth of crystal grains, and 0.2% proof stress after the annealing before press-forming exceeds 28.5 kgf/mm$^2$. The upper limit of O content is 0.002%. The lower limit of O content is 0.0001% from the economy of ingot-making process.

(3) Boron

Boron enhances the hot-working performance of the alloy. Excess amount of B induces the segregation of B at boundary of recrystallized grain formed during the annealing before press-forming, which inhibits the free migration of grain boundaries and results in the suppression of grain growth and the dissatisfaction of 0.2% proof stress after the annealing before press-forming. In particular, under the annealing condition before press-forming, which is specified in this invention, the suppression action against the grain growth is strong and the action does not uniformly affect on all grains, so a severe mixed grain structure appears accompanied with irregular elongation of material during press-forming.

Boron also increases the degree of {211} plane after annealing, which causes the crack on the skirt of material. Boron content above 0.0005 wt. % significantly enhances the suppression of grain growth, and the 0.2% proof stress exceeds 28.5 kgf/mm$^2$. Also the irregular elongation during press-forming appears, and the degree of {211} plane exceeds the upper limit specified in this invention. Based on these findings, the upper limit of B content is defined as 0.0005 wt. %.

(4) Silicon

Silicon is used as the deoxidizer during ingot-making of the alloy. When the Si content exceeds 0.05 wt. %, an oxide film of Si is formed on the surface of alloy during the annealing before press-forming. The oxide film degrades the fitness between die and alloy sheet during press-forming and results in the galling of die by alloy sheet. Consequently, the upper limit of Si content is specified as 0.05 wt. %. Less Si content improves the fitness of die and alloy sheet. The lower limit of Si content is not necessarily specified but 0.001 wt. % or higher content is preferred from the economy of ingot-making process.

(5) Nitrogen

Nitrogen is an element unavoidably entering into the alloy during ingot-making process. Nitrogen content higher than 0.0015 wt. % induces the concentration of N on the surface of alloy during the annealing before press-forming. The concentrated N on the surface of alloy degrades the fitness of die and alloy sheet to gall die with the alloy sheet. Consequently, the upper limit of N content is specified as 0.0015 wt. %. Although the lower limit of N content is not necessarily defined, 0.0001 wt. % or higher content is preferred from the economy of ingot-making process.

An alloy for shadow mask of this invention contains specific amount of B, O, Si, and N in its Fe—Ni basic structure, and has 28.5 kgf/mm$^2$ or lower 0.2% proof stress, and has 16% or less of degree of {211} plane. Most preferably, the composition further contains 0.0001–0.005 wt. % of C, 0.001–0.35 wt. % of Mn, and 0.001–0.05 wt. % of Cr.

As described above, the control of alloy composition and of 0.2% proof stress after the annealing before press-forming suppresses the galling of die during press-forming and gives a superior shape fixability. However, there remains the problem of crack generation on press-formed material. To cope with the problem, the inventors studied the relation between the crack generation and the crystal orientation during press-forming by changing the crystal orientation of the alloy sheet in various directions, and found that an effective condition to suppress the crack generation on the alloy material is to control the degree of {211} plane to maintain at or below a specified value, as well as to control the 0.2% proof stress after the annealing before press-forming to keep at or below a specified level.

FIG. 1 shows the relation among crack generation on alloy sheet during press-forming, degree of {211} plane, and 0.2% proof stress. The alloy sheet contains 34–38 wt. % of Ni, 0.0002 wt. % or less of B, and 0.002 wt. % or less of O. The white circles in FIG. 1 correspond to no-crack generation, and points of x mark correspond to crack generation. The degree of {211} plane is determined from the relative X-ray intensity ratio of (422) diffraction plane of alloy sheet after the annealing before press-forming divided by the sum of relative X-ray diffraction intensity ratio of (111), (200), (220), (311), (331), and (420) diffraction planes. The relative X-ray intensity ratio is defined as the value of X-ray diffraction intensity observed on each diffraction plane divided by the theoretical X-ray intensity of that diffraction plane. For example, the relative X-ray intensity ratio of (111) diffraction plane is the value of X-ray diffraction intensity of (111) plane divided by the theoretical X-ray diffraction intensity of (111) diffraction plane. The degree of {211} plane is determined from the measurement of X-ray diffraction intensity of (422) diffraction plane which has equivalent orientation with (211) plane.

FIG. 1 clearly shows that the case where 0.2% proof stress does not exceed 28.5 kgf/mm$^2$ and that the degree of {211} plane not exceeding 16% does not induce crack on alloy sheet during press-forming, which fact indicates the effect of this invention. Based on the finding, the invention specifies 16% or less of the degree of {211} plane as the condition to suppress crack generation on the alloy sheet.

As described above, the excellent press-form quality aimed by this invention is obtained by limiting the content of O, B, Si, and N in the alloy of this invention, the 0.2% proof stress, and the degree of {211} plane to each specified level.

Figure 2:
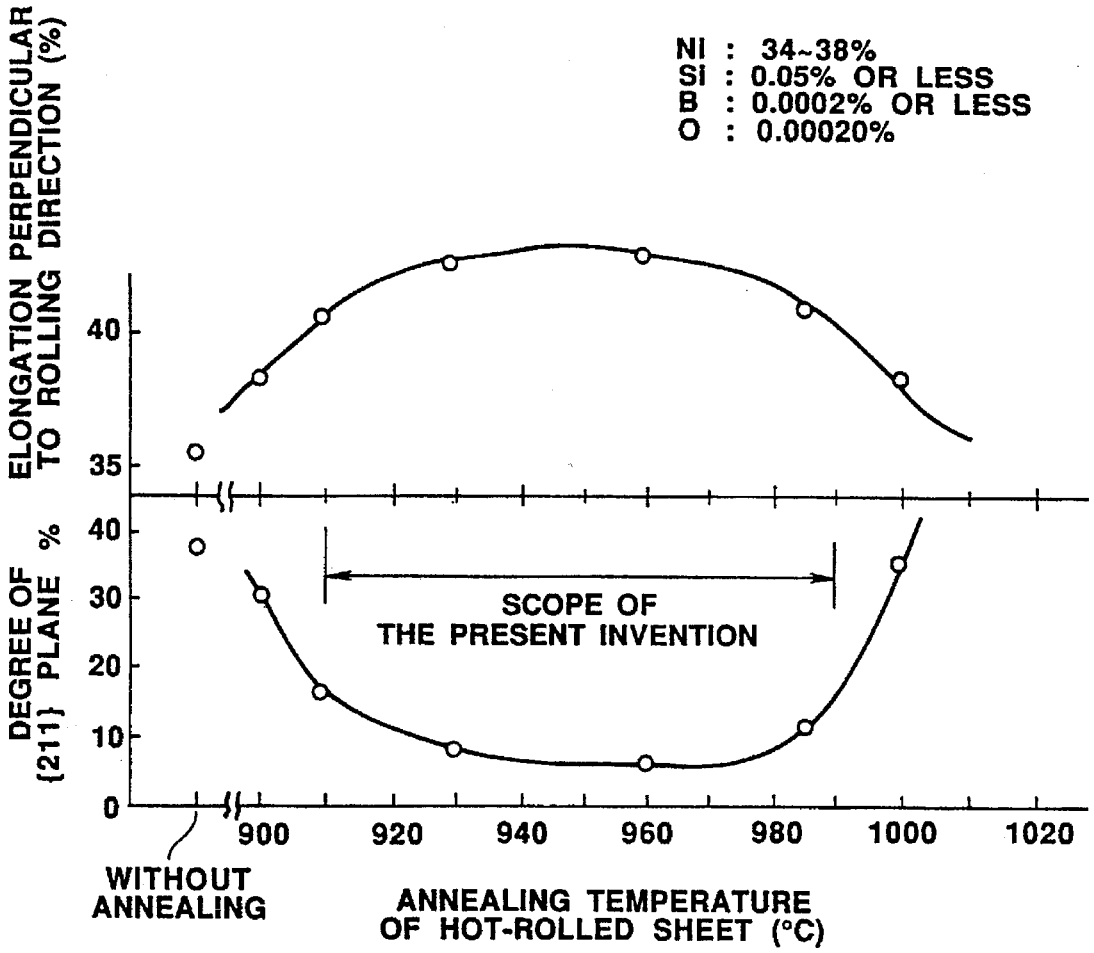
FIG. 2 shows the relation among degree of {211} plane, elongation perpendicular to rolling direction, and annealing temperature of hot-rolled sheet, being described in the preferred embodiment-1.

A method to maintain the degree of {211} plane at or below 16% is described below referring to FIG. 2. FIG. 2 shows the relation among degree of {211} plane, elongation perpendicular to rolling direction, and annealing temperature of hot-rolled sheet. The hot-rolled strip was subjected to annealing, cold-rolling, annealing at 890° C. for 1 min., finish cold-rolling to 21% reduction ratio, and annealing before press-forming at 750° C. for 15 min. The annealing of the hot-rolled sheet was carried in a temperature range of 900°–1000° C. As a comparative example, a hot-rolled strip not annealed was treated under the same condition as thereabove: cold-rolling, annealing, finish cold-rolling, and annealing before press-forming. Both the degree of {211} plane on the alloy sheet treated by the process described above and the elongation perpendicular to rolling direction of the alloy sheet during tensile testing were determined. The degree of {211} plane gave 16% or lower value at 910°–990° C. of annealing temperature of the hot-rolled sheet. Consequently, this invention specifies the temperature range of annealing of hot-rolled sheet in a range of 910°–990° C. to assure the degree of {211} plane at or below 16%.

The effect of annealing of hot-rolled sheet in this invention is performed when the hot-rolled alloy strip is not yet treated by the hot-rolled sheet annealing and when the strip is fully recrystallized. To acquire the satisfactory degree of {211} plane being focused on in this invention, the uniform heat treatment of the slab after slabbing is not preferable. For example, when a uniform heat treatment is carried at 1200° C. or higher temperature for 10 hours or longer period, the degree of {211} plane exceeds the range specified in this invention. Therefore, such a uniform heat treatment must be avoided.

The mechanism of crack generation during press-forming under the condition of above 16% of the degree of crystal plane is not clear. FIG. 2 shows the trend that a high degree of {211} plane gives a low elongation perpendicular to the rolling direction. Increased degree of {211} plane decreases the elongation and lowers the fracture limit, then presumably induces cracks.

To keep the degree of {211} plane at 16% or lower level and to maintain the 0.2% proof stress after the annealing before press-forming at 28.5 kgf/mm$^2$ or lower level, the control of austenite grain size, of finish cold-rolling reduction ratio, and of condition of the annealing before press-forming is important, also.

Figure 3:
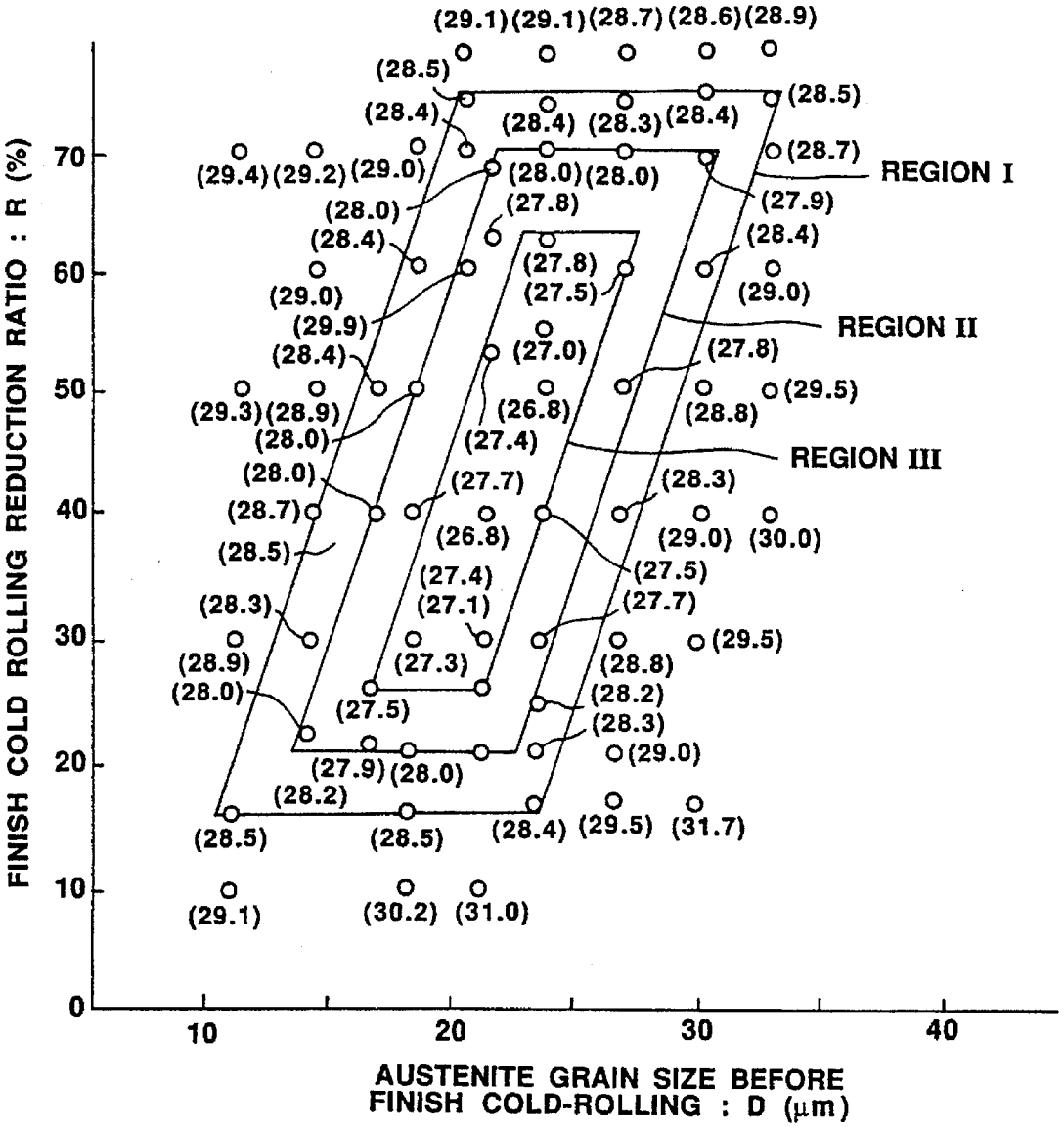
FIG. 3 shows the relation among 0.2% proof stress after the annealing before press-forming, austenite grain size before the finish cold-rolling, and final cold-rolling reduction ratio, being described in the preferred embodiment-1.

FIG. 3 shows the relation among 0.2% proof stress after the annealing before press-forming, austenite grain size before finish cold-rolling, and finish cold-rolling reduction ratio. The applied alloy had the composition of 34–38 wt. % of Ni, 0.05 wt. % or less of Si, 0.0002 wt. % or less of B, and 0.002 wt. % of less of O. The hot-rolled alloy strip having the composition thereabove was subjected to hot-rolled sheet annealing in a temperature range of 910°–990° C., cold-rolling, recrystallization annealing, finish cold-rolling, and annealing before press-forming at 750° C. for 15 min. to produce the alloy sheet. The alloy sheet was tested for tensile strength to determine 0.2% proof stress. In the annealing after cold-rolling, the specified austenite grain size was obtained by varying the annealing temperature.

FIG. 3 indicates that the 0.2% proof stress not exceeding 28.5 kgf/mm$^2$ is achieved under the conditions given below.

Finish cold-rolling reduction ratio (R %): 16–75%

$6.38D-133.9 \leqq R \leqq 6.38D-51.0$ where D is the austenite grain size (μm) before finish cold-rolling.

In the case of $R<16\%$ or $6.38D-133.9>R$, the condition specified in this invention for the annealing before press-forming gives insufficient recrystallization, insufficient growth of recrystallized grain, and 0.2% proof stress exceeding 28.5 kgf/mm$^2$, and results in a dissatisfactory alloy sheet. If $R>75\%$ or $R>6.78D-51.0$, then the condition specified in this invention for the annealing before press-forming allows 100% recrystallization but gives excess frequency of nucleation during recrystallization which decreases the size of recrystallized grain. In that case, the 0.2% proof stress exceeds 28.5 kgf/mm$^2$, and the alloy sheet has unsatisfactory quality.

From the above described relations, the condition to achieve 28.5 kgf/mm$^2$ or below of 0.2% proof stress is specified as 16–75% of finish cold-rolling reduction ratio (R %) and $6.38D-133.9 \leqq R \leqq 6.38D-51.0$. An adequate value of finish cold-rolling reduction ratio (R %) and of austenite grain size (D μm) before the finish cold-rolling within the range specified above realize the degree of {211} plane on the surface of alloy sheet after the annealing before press-forming at or below 16%.

Control of above described structure of the alloy of this invention is performed by the combination of the control of comprehensive structure during hot-rolled sheet annealing, of grain size before finish cold-rolling, and of finish cold-rolling reduction ratio responding to the grain size. Through the control, the frequency of nucleation during recrystallization is adequately controlled. An optimized combination of austenite grain size (D μm) and finish cold-rolling reduction ratio (R %) further decreases the 0.2% proof stress after the annealing before press-forming. In concrete terms, the selection of R and D to satisfy the condition of $21\% \leqq R \leqq 70\%$ and $6.38D-122.6 \leqq R \leqq 6.38D-65.2$ reduces 0.2% proof stress to 28.0 kgf/mm$^2$ or lower value.

Furthermore, the selection of R and D to satisfy the condition of $26\% \leqq R \leqq 63\%$ and $6.38D-108.0 \leqq R \leqq 6.38D-$ 79.3 reduces 0.2% proof stress to 27.5 kgf/mm$^2$ or lower value. The austenite grain size focused on in this invention is obtained by applying hot-rolled sheet annealing to a hot-rolled strip, by cold-rolling, and by annealing at 860°–950° C. for 0.5–2 min.

Figure 4:
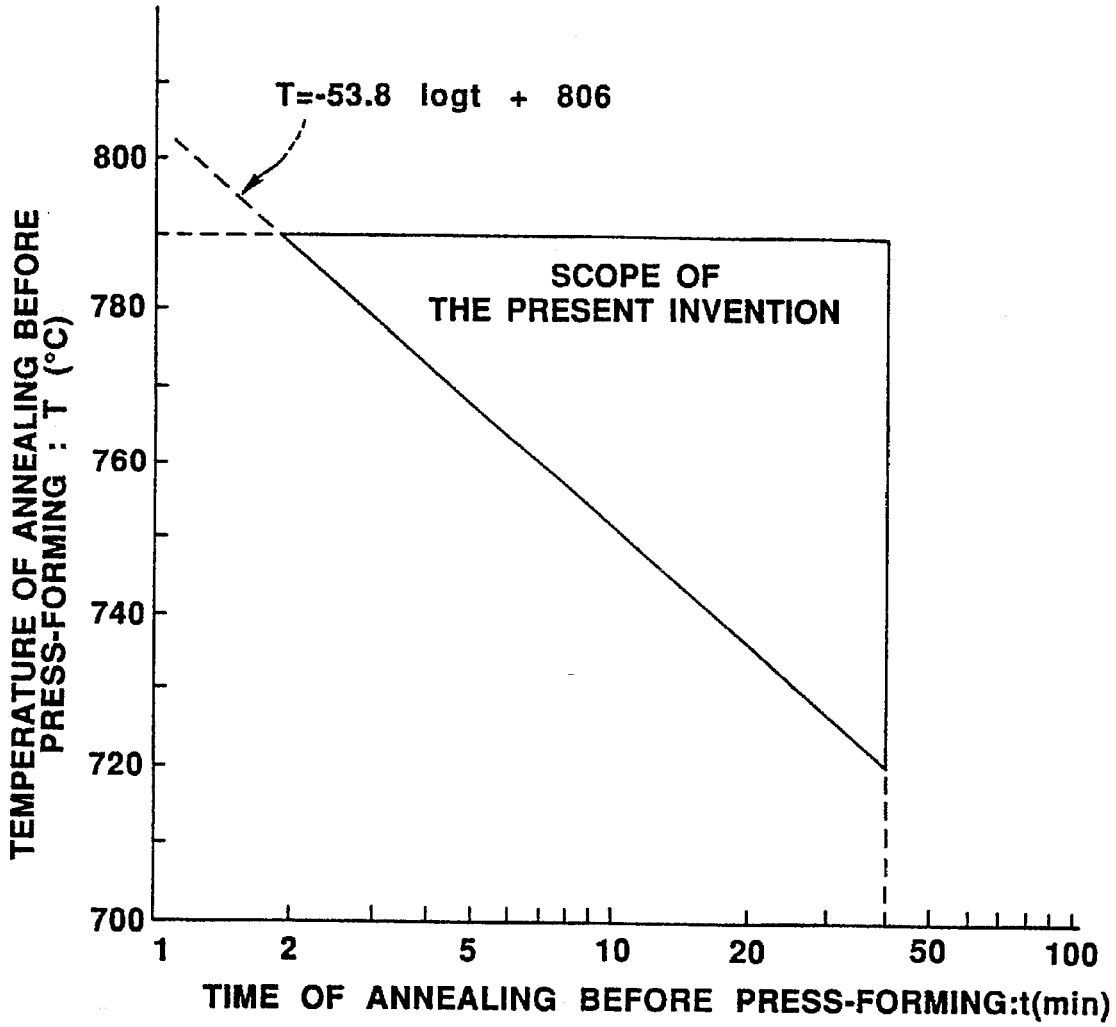
FIG. 4 shows the relation among 0.2% proof stress after the annealing before press-forming, degree of {211} plane, and the condition of annealing before press-forming, being described in the preferred embodiment-1.

According to this invention, to obtain the degree of {211} plane on the surface of alloy sheet not higher than 16% and to obtain the 0.2% proof stress after the annealing before press-forming not higher than 28.5 kgf/mm$^2$ , the control of condition of annealing before press-forming is important in addition to the specifications described above. The condition is described below referring to FIG. 4. FIG. 4 shows the relation among 0.2% proof stress after the annealing before press-forming, degree of {211} plane, and condition of annealing before press-forming. Horizontal axis is the duration of annealing before press-forming, t (min.), and vertical axis is the temperature of annealing before press-forming, T (°C.). As clearly shown in FIG. 4, even if the hot-rolled sheet annealing condition, austenite grain size before finish cold-rolling, and finish cold-rolling reduction ratio stay within the range specified in this invention, when the temperature of annealing before press-forming has the relation of $$T<-53.8 \log t+806,$$

then the satisfactory recrystallization is not conducted and 0.2% proof stress exceeds 28.5 kgf/mm$^2$ and the degree of {211} plane exceeds 16%, which latter three characteristic values. do not satisfy the range specified in this invention. When the temperature of annealing before press-forming, T, exceeds 790° C. or when the duration of annealing before press-forming, t, exceeds 40 min., then the {211} plane develops to increase the degree of {211} plane to higher than 16%, which is inadequate, also. Consequently, as the condition to obtain the value of 0.2% proof stress and degree of {211} plane specified in this invention, this invention specifies the temperature of annealing before press-forming, T (°C.), in a range of 720°–790° C., and the duration of annealing before press-forming, t, in a range of 2–40 min. and $T \geqq -53.8 \log t+806$.

FIG. 5 shows the relation among 0.2% proof stress after the annealing before press-forming, degree of {211} plane, and condition of the annealing before press-forming. FIG. 5 indicates the characteristics of alloy No. 1 which is an alloy of this invention, and No. 7 and No. 8 which are comparative alloys. The hot-rolled strips of these alloys were prepared by annealing at 910°–990° C., cold-rolling, recrystallization annealing, and finish cold-rolling. The change of 0.2% proof stress and of degree of {211} plane during the annealing of the alloy sheet was measured by varying the duration of annealing. The condition of hot-rolled sheet annealing, austenite grain size before finish cold-rolling, and finish cold-rolling reduction ratio remained within the range specified in this invention. According to FIG. 5, within the condition of annealing before press-forming specified in this invention, the alloy of this invention gives both 0.2% proof stress and degree of {211} plane outside of the range specified in this invention even when they were annealed at 750° C. The comparative alloys clearly have problems in their press-forming performance with 0.2% proof stress exceeding 28.5 kgf/mm$^2$, and the degree of {211} plane exceeding the limit specified in this invention. Accordingly, this invention emphasizes the alloy composition as well as the specification on manufacturing method.

The annealing before press-forming in this invention may be carried before photo-etching. In that case, if the condition of annealing before press-forming is kept within the range specified in this invention, then a satisfactory photo-etching quality is secured.

There are other methods to limit the degree of {211} plane on the thin alloy sheet after the annealing before press-forming within the range specified in this invention. Examples of these methods are quenching solidification and comprehensive structure control through the control of recrystallization during hot-working.

EXAMPLE 1

A series of ladle refining produced alloy ingots of No. 1 through No. 18 having the composition listed in Table 1. These ingots were subjected to slabbing, surface scaring, and hot-rolling to provide hot-rolled strips. The heating condition in hot-rolling was 1100° C. for 3 hours. The hot-rolling performed a sufficient recrystallization. The hot-rolled strips were annealed at 930° C. After annealing, the hot-rolled strips were subject to cold-rolling, annealing under the condition given in Table 3, and finish cold-rolling at 21% of reduction ratio to obtain alloy sheets each having 0.25 mm of thickness. The alloy sheets were etched to make flat masks, which flat masks were then treated by the annealing before press-forming at 750° C. for 15 min. The press-forming was applied to these flat masks after the annealing before press-forming, and the shape fixability, fitness to die, and crack generation on material were inspected, Regarding the shape fixability, evaluation grades included very good (◎), good (○), rather poor (Δ), and bad (x). For the fitness to die, evaluation grades included good without ironing mark (○), rather poor with ironing mark (Δ), and lots of ironing marks (x). The 0.2% proof stress and elongation perpendicular to rolling direction, tensile properties, and degree of {211} plane were determined after the annealing before press-forming. The tensile property was measured at ambient temperature. The degree of {211} plane was determined by X-ray diffraction method.

As clearly shown in Table 2, materials of No. 1 through No. 13, which have the chemical composition, degree of {211} plane, and 0.2% proof stress within the range specified in this invention, show excellent press-form quality. To the contrary, material No. 14 gives Si content above the upper limit of this invention and raises a problem in fitness to die. Material No. 16 gives N content above the upper limit of this invention and raises problem of fitness to die. Material No. 15 gives O content above the upper limit of this invention and also gives 0.2% proof stress above the upper limit, 28.5 kgf/mm$^2$, which results in a poor shape fix ability and induces crack generation to raise problem of press-form quality. Material No. 17 gives B content above the upper limit of this invention, and material No. 18 gives O content and B content above the upper limit of this invention and gives 0.2% proof stress above the upper limit of this invention, 28.5 kgf/mm$^2$, to degrade shape fixability. The comparative material No. 17 and No. 18 give the degree of {211} plane above the upper limit of this invention, and also shows crack on alloy to degrade press forming quality.

The above discussion clearly shows that an alloy sheet having excellent press-form quality is prepared by adjusting the chemical composition, grade of {211} plane, and 0.2% proof stress within the range specified in this invention.

TABLE 1

| Material No. | Alloy No. | Chemical component Ni | Si | O | N | B | C | Mn | Cr | Austenite grain size before finish cold-rolling (μm) |
|---|---|---|---|---|---|---|---|---|---|---|
| 1 | 1 | 35.9 | 0.005 | 0.0010 | 0.0008 | 0.00005 | 0.0013 | 0.25 | 0.01 | 18 |
| 2 | 2 | 36.1 | 0.02 | 0.0013 | 0.0010 | 0.0001 | 0.0011 | 0.26 | 0.02 | 17 |
| 3 | 3 | 36.0 | 0.03 | 0.0014 | 0.0011 | 0.0001 | 0.0015 | 0.04 | 0.02 | 17 |
| 4 | 4 | 36.5 | 0.04 | 0.0020 | 0.0015 | 0.0002 | 0.0045 | 0.30 | 0.02 | 15 |
| 5 | 5 | 35.8 | 0.01 | 0.0015 | 0.0010 | 0.0002 | 0.0029 | 0.25 | 0.06 | 14 |
| 6 | 6 | 35.7 | 0.01 | 0.0012 | 0.0009 | 0.0001 | 0.0029 | 0.27 | 0.01 | 15 |
| 7 | 7 | 36.0 | 0.02 | 0.0008 | 0.0007 | 0.0002 | 0.0009 | 0.11 | 0.03 | 14 |
| 8 | 8 | 36.2 | 0.05 | 0.0005 | 0.0005 | 0.0001 | 0.0007 | 0.05 | 0.02 | 12 |
| 9 | 9 | 36.3 | 0.001 | 0.0002 | 0.0002 | 0.0001 | 0.0005 | 0.005 | 0.001 | 13 |
| 10 | 10 | 35.5 | 0.04 | 0.0018 | 0.0011 | 0.0001 | 0.0032 | 0.01 | 0.01 | 12 |
| 11 | 11 | 35.8 | 0.03 | 0.0016 | 0.0012 | 0.00001 | 0.0030 | 0.20 | 0.02 | 20 |
| 12 | 12 | 35.9 | 0.05 | 0.0019 | 0.0013 | 0.00002 | 0.0050 | 0.29 | 0.03 | 22 |
| 13 | 13 | 36.0 | 0.01 | 0.0017 | 0.0012 | 0.00001 | 0.0037 | 0.05 | 0.04 | 24 |
| 14 | 14 | 35.6 | 0.08 | 0.0020 | 0.0014 | 0.0002 | 0.0021 | 0.23 | 0.03 | 16 |
| 15 | 15 | 36.2 | 0.05 | 0.0035 | 0.0012 | 0.0001 | 0.0017 | 0.31 | 0.04 | 15 |
| 16 | 16 | 36.3 | 0.04 | 0.0018 | 0.0020 | 0.0002 | 0.0019 | 0.25 | 0.03 | 17 |
| 17 | 17 | 36.0 | 0.04 | 0.0017 | 0.0015 | 0.0006 | 0.0025 | 0.28 | 0.04 | 15 |
| 18 | 18 | 35.8 | 0.05 | 0.0023 | 0.0016 | 0.0021 | 0.0032 | 0.27 | 0.04 | 14 |

TABLE 2

| Material No. | Alloy No. | Tensile property[1)] 0.2% proof stress (kgf/mm$^2$) | Elongation perpendicular to rolling direction (%) | Degree of {211} plane (%) | Press-form quality Shape fix ability | Fitness to die | Crack generation on alloy sheet |
|---|---|---|---|---|---|---|---|
| 1 | 1 | 28.0 | 42.3 | 8 | ◎ | ○ | No |
| 2 | 2 | 27.9 | 41.8 | 10 | ◎ | ○ | No |
| 3 | 3 | 27.9 | 42.0 | 9 | ◎ | ○ | No |
| 4 | 4 | 28.5 | 40.0 | 16 | ○ | ○ | No |
| 5 | 5 | 28.3 | 42.3 | 15 | ○ | ○ | No |
| 6 | 6 | 28.0 | 43.5 | 13 | ◎ | ○ | No |
| 7 | 7 | 27.7 | 41.2 | 16 | ◎ | ○ | No |
| 8 | 8 | 27.3 | 43.2 | 15 | ◎ | ○ | No |
| 9 | 9 | 26.8 | 44.5 | 15 | ◎ | ○ | No |
| 10 | 10 | 28.4 | 41.8 | 14 | ○ | ○ | No |
| 11 | 11 | 28.4 | 40.7 | 9 | ○ | ○ | No |
| 12 | 12 | 28.5 | 42.7 | 7 | ○ | ○ | No |
| 13 | 13 | 28.4 | 44.0 | 5 | ○ | ○ | No |
| 14 | 14 | 28.4 | 40.1 | 15 | ○ | x | No |
| 15 | 15 | 28.9 | 39.0 | 16 | Δ | ○ | Yes |
| 16 | 16 | 28.5 | 41.3 | 12 | ○ | x | No |
| 17 | 17 | 30.0 | 38.9 | 30 | x | ○ | Yes |
| 18 | 18 | 30.4 | 38.0 | 32 | x | ○ | Yes |

TABLE 3

| | | | |
|---|---|---|---|
| Annealing condition | 870 °C. × 1 min | 880 °C. × 0.8 min | 890 °C. × 1 min |
| Material No. | No. 8~No. 10 | No. 4~No.7 | No.1~No.3 No.14~No.18 |
| Annealing condition | 910 °C. × 1 min | 920 °C. × 0.5 min | 930 °C. × 0.5 min |
| Material No. | No. 11 | No. 12 | No. 13 |

EXAMPLE 2

Hot-rolled strips of alloy No. 1, 3, 5, 9, and 12, which were used in Example 1, were employed. The hot-rolled sheet annealing was applied to these materials under various annealing conditions given in Table 4, and no annealing was applied to one material which is also given in the table. They were subjected to cold-rolling, annealing at 890° C. for 1 min., and finish cold-rolling at 21% reduction ratio to obtain alloy sheets of 0.25 mm thickness. These alloy sheets were etched and formed to flat masks. The flat masks were then treated by the annealing before press-forming at 750° C. for 15 min. to give materials No. 19 through No. 23. The flat masks treated by the annealing before press-forming were press-formed and were tested for press-form quality, which quality is given in Table 4. The method for measuring properties given in Table 4 was the same as in Example 1.

Materials of No. 19 and No. 20 have chemical composition, degree of {211} plane, and 0.2% proof stress, within the range specified in this invention, have austenite grain size before finish cold-rolling, finish cold-rolling reduction ratio, and condition of the annealing before press-forming within the range specified in this invention, and have the condition of hot-rolled sheet annealing within the range specified in this invention. As shown in Table 4, materials No. 19 and No. 20 give excellent press-form quality.

On the contrary, material No. 21 gives the temperature of hot-rolled sheet annealing below the lower limit of this invention, material No. 22 gives the temperature of hot-rolled sheet annealing above the upper limit of this invention, and material No. 23 had no hot-rolled sheet annealing. All these three materials, No. 21, 22, and 23, exceed the upper limit of this invention in the degree of {211} plane, and generate crack on alloy sheet during press-forming. In addition, material No. 23 gives 0.2% proof stress above the upper limit of this invention, 28.5 kgf/mm$^2$, and raises a problem of shape fixability during press-forming. Consequently, keeping the degree of {211} plane within the range specified in this invention is important.

and the cold-rolling reduction ratio within the range specified in this invention give 16% or less of the degree of {211} plane. Materials of that case are No. 25 through No. 30, No. 36 through No. 38, and No. 42 through No. 61. In particular, materials of No. 25, No. 30, No. 33, No. 36, No. 42, No. 44, No. 45, No. 49, No. 55, No. 58, and No. 61 fall in the region 1 of FIG. 3, and they give 28.5 kgf/mm$^2$ or lower value of 0.2% proof stress. Materials of No. 26, No. 28, No. 29, No. 43, No. 47, No. 50, No. 54, No. 60, and No. 38 fall in the region 2 of FIG. 3, and they give 28.0 kgf/mm$^2$ or lower value of 0.2% proof stress. Materials of No. 27, No. 46, No. 48, No, 51, No. 52, No. 53, No. 56, No. 57, No. 59, and No. 37 fall in the region 3 of FIG. 3, and they give 27.5 kgf/mm$^2$ or lower value of 0.2% proof stress. All of these materials show excellent press-form quality. Accordingly, the decrease of 0.2% proof stress increases the shape fix ability.

Contrary to the above preferable embodiment, materials of No. 24, No. 31, No. 32, No. 34, No. 35, No. 39, and No. 40 give at least one of the austenite grain size before finish

TABLE 4

| Material No. | Alloy No. | Temperature of hot-rolled sheet annealing (°C.) | Tensile property: 0.2% proof stress (kgf/mm$^2$) | Tensile property: Elongation perpendicular to rolling direction (%) | Degree of {211} plane (%) | Press-form quality: Shape fix ability | Press-form quality: Fitness to die | Press-form quality: Crack generation on alloy sheet | Austenite grain size before finish cold-rolling (μm) |
|---|---|---|---|---|---|---|---|---|---|
| 19 | 1 | 930 | 28.2 | 42.3 | 8 | ◎ | ○ | No | 18 |
| 20 | 1 | 960 | 27.9 | 42.5 | 6 | ◎ | ○ | No | 18 |
| 21 | 1 | 900 | 28.4 | 37.6 | 30 | ○ | ○ | Yes | 18 |
| 22 | 1 | 1000 | 28.5 | 38.1 | 35 | ○ | ○ | Yes | 18 |
| 23 | 1 | —* | 28.7 | 35.3 | 37 | Δ | ○ | Yes | 17 |

EXAMPLE 3

Hot-rolled strips of alloy No. 1, 2, 4, 6, 7, 11, 12, 13, and 18, which were used in Example 1, were employed. These strips were subjected to hot-rolled sheet annealing, cold-rolling, annealing, and finish cold-rolling to obtain alloy sheets of 0.25 mm thickness. The temperature of hot-rolled sheet annealing was 930° C. The annealing before finish cold-rolling was carried by holding the material at a temperature level given in Table 5 for 1 min. The finish cold-rolling was conducted at a reduction ratio given in Table 5. The alloy sheets were etched to make flat masks, which flat masks were then treated by the annealing before press-forming at 750° C. for 15 min. to obtain materials No. 24 through No. 61. The press-forming was applied to these flat masks after the annealing before press-forming, and the press-form quality was determined, which quality is given in Table 5 and Table 6. The measuring method for each property given in these tables was the same as in Example 1.

When the chemical composition, condition of hot-rolled sheet annealing, and condition of the annealing are kept within the range specified in this invention, materials which have both the austenite grain size before finish cold-rolling cold-rolling and the finish cold-rolling reduction ratio does not satisfy the limit specified in this invention. They are out of scope of this invention for at least one of the 0.2% proof stress and the degree of {211} plane, and they raise problem of at least one of the shape fixability and crack generation on alloy sheet during press-forming.

Material No. 41 was treated by the annealing before finish cold-rolling at 850° C. for 1 min. Such an annealing condition gives 10.0 μm of austenite grain size, so the 0.2% proof stress exceeds 28.5kgf/mm$^2$ even if the finish cold-rolling reduction ratio is selected to 15%. These figures can not provide a shape fixability during press-forming to satisfy the specifications of this invention.

As discussed in detail thereabove, even under the condition that the chemical composition, condition of hot-rolled sheet annealing, and condition of the annealing before press-forming are kept in the range specified in this invention, it is important to keep the austenite grain size before finish cold-rolling and the finish cold-rolling reduction ratio within the range specified in this invention to obtain satisfactory press-form quality being aimed by this invention.

TABLE 5

| Material No. | Alloy No. | Temperature of annealing before finish cold-rolling (°C.) | Austenite grain size before finish cold-rolling (μm) | Finish cold-rolling reduction ratio (%) | Tensile property: 0.2% proof stress (kgf/mm²) | Tensile property: Elongation perpendicular to rolling direction (%) |
|---|---|---|---|---|---|---|
| 24 | 1 | 890 | 18.0 | 10 | 30.2 | 36.5 |
| 25 | | " | " | 16 | 28.5 | 40.0 |
| 26 | | " | " | 21 | 28.0 | 42.3 |
| 27 | | " | " | 30 | 27.3 | 40.5 |
| 28 | | " | " | 40 | 27.7 | 41.5 |
| 29 | | " | " | 50 | 28.0 | 40.8 |
| 30 | | " | " | 60 | 28.4 | 42.9 |
| 31 | | " | " | 70 | 29.0 | 36.4 |
| 32 | 2 | 860 | 11.0 | 21 | 28.6 | 35.6 |
| 33 | 1 | 920 | 23.3 | 21 | 28.3 | 40.7 |
| 34 | | 930 | 26.5 | 21 | 29.0 | 35.0 |
| 35 | 2 | 860 | 11.0 | 50 | 29.3 | 39.0 |
| 36 | 1 | 880 | 16.5 | " | 28.4 | 42.0 |
| 37 | | 920 | 23.3 | " | 26.8 | 41.7 |
| 38 | | 930 | 26.5 | " | 27.8 | 43.0 |
| 39 | | 940 | 32.5 | " | 29.5 | 37.8 |
| 40 | | 920 | 23.3 | 78 | 29.1 | 37.3 |
| 41 | 8 | 850 | 10.0 | 15 | 30.1 | 36.7 |
| 42 | 2 | 860 | 11.0 | 16 | 28.5 | 40.1 |
| 43 | 6 | 870 | 14.0 | 22.5 | 28.0 | 41.3 |
| 44 | | " | 14.0 | 30 | 28.3 | 41.5 |
| 45 | | " | 14.0 | 37.5 | 28.5 | 43.2 |
| 46 | 1 | 880 | 16.5 | 26 | 27.5 | 43.6 |
| 47 | | 880 | 16.5 | 40 | 28.0 | 45.2 |
| 48 | 1 | 890 | 18.0 | 35 | 27.4 | 41.6 |
| 49 | 12 | 910 | 20.0 | 74.5 | 28.5 | 40.4 |
| 50 | 11 | 910 | 21.0 | 21 | 27.9 | 42.0 |
| 51 | | 910 | 21.0 | 26 | 27.5 | 42.5 |
| 52 | | 910 | 21.0 | 30 | 27.2 | 41.7 |
| 53 | | 910 | 21.0 | 53 | 27.4 | 40.5 |
| 54 | | 910 | 21.0 | 68.5 | 28.0 | 41.0 |
| 55 | 9 | 920 | 23.3 | 17 | 28.4 | 42.3 |
| 56 | | 920 | 23.3 | 40 | 27.5 | 41.1 |
| 57 | | 920 | 23.3 | 62.5 | 27.4 | 41.5 |
| 58 | 13 | 930 | 26.5 | 40 | 28.3 | 41.5 |
| 59 | | 930 | 26.5 | 60 | 27.5 | 41.7 |
| 60 | 7 | 935 | 29.8 | 69.5 | 27.9 | 41.6 |
| 61 | 4 | 940 | 32.5 | 74.5 | 28.5 | 40.2 |

TABLE 6

| Material No. | Alloy No. | Degree of {211} plane (%) | Press-form quality: Shape fix ability | Press-form quality: Fitness to die | Press-form quality: Crack generation on alloy sheet |
|---|---|---|---|---|---|
| 24 | 1 | 15 | x | ○ | Yes |
| 25 | | 16 | ○ | ○ | No |
| 26 | | 8 | ◎ | ○ | No |
| 27 | | 15 | ◎ | ○ | No |
| 28 | | 16 | ◎ | ○ | No |
| 29 | | 13 | ◎ | ○ | No |
| 30 | | 5 | ○ | ○ | No |
| 31 | | 12 | x | ○ | Yes |
| 32 | 2 | 15 | Δ | ○ | Yes |
| 33 | 1 | 15 | ○ | ○ | No |
| 34 | | 7 | x | ○ | Yes |
| 35 | 2 | 19 | x | ○ | Yes |
| 36 | 1 | 9 | ○ | ○ | No |
| 37 | | 15 | ◎ | ○ | No |
| 38 | | 4 | ◎ | ○ | No |
| 39 | | 7 | x | ○ | Yes |
| 40 | | 25 | x | ○ | Yes |
| 41 | 8 | 20 | x | ○ | Yes |
| 42 | 2 | 12 | ○ | ○ | No |
| 43 | 6 | 13 | ◎ | ○ | No |

TABLE 6-continued

| Material No. | Alloy No. | Degree of {211} plane (%) | Press-form quality: Shape fix ability | Press-form quality: Fitness to die | Press-form quality: Crack generation on alloy sheet |
|---|---|---|---|---|---|
| 44 | | 10 | ○ | ○ | No |
| 45 | | 5 | ○ | ○ | No |
| 46 | 1 | 2 | ◎ | ○ | No |
| 47 | | 1 | ◎ | ○ | No |
| 48 | 1 | 14 | ◎ | ○ | No |
| 49 | 12 | 16 | ○ | ○ | No |
| 50 | 11 | 8 | ◎ | ○ | No |
| 51 | | 8 | ◎ | ○ | No |
| 52 | | 10 | ◎ | ○ | No |
| 53 | | 13 | ◎ | ○ | No |
| 54 | | 15 | ◎ | ○ | No |
| 55 | 9 | 6 | ○ | ○ | No |
| 56 | | 12 | ◎ | ○ | No |
| 57 | | 15 | ◎ | ○ | No |
| 58 | 13 | 13 | ○ | ○ | No |
| 59 | | 15 | ◎ | ○ | No |
| 60 | 7 | 15 | ◎ | ○ | No |
| 61 | 4 | 16 | ○ | ○ | No |

EXAMPLE 4

Hot-rolled strips of alloy No. 1, 4, 17, 18, 9, 10, and 12, which were used in Example 1, were employed. These strips were subjected to hot-rolled sheet annealing, cold-rolling, annealing, and finish cold-rolling to obtain alloy sheets of 0.25 mm thickness. The temperature of hot-rolled sheet annealing was 930° C. The annealing before finish cold-rolling was carried by holding the material at 890° C. for 1 min. The finish cold-rolling was conducted at 21% reduction ratio. The alloy sheets were etched to make flat masks, which flat masks were then treated by the annealing before press-forming under the condition given in Table 7 to obtain materials No. 62 through No. 79. The press-forming was applied to these flat masks after the annealing before press-forming, and the press-form quality was determined, which quality is given in Table 7. The measuring method for each property given in the table was the same as in Example 1.

Materials of No. 62, No. 64, No. 71 through No. 79, and No. 65 give chemical composition, condition of hot-rolling, austenite grain size before finish cold-rolling, finish cold-rolling reduction ratio, and condition of the annealing before press-forming within the range specified in this invention. All these materials give 16% or less of the degree of {211} plane and give 0.2% proof stress within the range specified in this invention to show excellent press-form quality.

Material No. 66 gives, however, the temperature of the annealing before press-forming below the lower limit of this invention, material No. 67 gives the temperature of the annealing before press-forming above the upper limit of this invention, and material No. 68 gives the duration of the annealing before press-forming above the upper limit of this invention. All the materials of No. 66 through No. 68 exceed 16% in the degree of {211} plane and generate cracks on alloy sheets. Material No. 66 gives the temperature below the lower limit of this invention, and gives 28.5 kgf/mm$^2$ of 20% proof stress, which suggests that the material has a problem in shape fixability during press-forming. Material No. 63 does not satisfy the condition of [T≧−53.8 log t+806], (T=temperature of the annealing before press-forming, t=duration of annealing). The material gives 0.2% proof stress above 28.5 kgf/mm$^2$, which indicates that the material has a problem in shape fixability during press-forming. The material also gives the degree of {211} plane higher than 16% and generates cracks on alloy sheet.

Materials of No. 69 and No. 70 employed comparative alloys. Even the annealing before press-forming is carried at 750° C. for 60 min., their 0.2% proof stress values exceed 28.5 kgf/mm$^2$ and they have problem in shape fix ability during press-forming. The degree of {211} plane of these materials exceed 16%, and cracks are generated on alloy sheet.

As described in detail thereabove, even under the condition that the chemical composition, condition of hot-rolled sheet annealing, austenite grain size before finish cold-rolling, and finish cold-rolling reduction ratio are kept in the range specified in this invention, it is important to keep the condition of annealing before press-forming within the range specified in this invention to obtain satisfactory press-form quality being aimed by this invention.

TABLE 7

| | | | | | Tensile property | | | Press-form quality | | |
|---|---|---|---|---|---|---|---|---|---|---|
| | | Condition of annealing before press-forming | | Austenite grain | 0.2% proof | Elongation perpendicular | Degree | Shape | | Crack generation |
| Material No. | Alloy No. | Temperature (°C.) | Duration (min) | size before finish cold-rolling (μm) | stress (kgf/mm$^2$) | to rolling direction (%) | of {211} plane (%) | fix ability | Fitness to die | on alloy sheet |
| 62 | 1 | 730 | 30 | 18 | 28.4 | 40.8 | 14 | ○ | ○ | No |
| 63 | | 750 | 5 | 18 | 29.4 | 39.1 | 22 | x | ○ | Yes |
| 64 | | 750 | 20 | 18 | 27.9 | 42.3 | 8 | ⊙ | ○ | No |
| 65 | | 790 | 2 | 18 | 28.5 | 41.0 | 16 | ○ | ○ | No |
| 66 | | 700 | 60 | 18 | 28.7 | 37.6 | 28 | Δ | ○ | Yes |
| 67 | | 800 | 2 | 18 | 27.7 | 34.9 | 35 | ⊙ | ○ | Yes |
| 68 | | 750 | 60 | 18 | 27.5 | 37.3 | 20 | ⊙ | ○ | Yes |
| 69 | 17 | 750 | 60 | 15 | 28.9 | 37.4 | 30 | Δ | Δ | Yes |
| 70 | 18 | 750 | 60 | 14 | 29.2 | 38.0 | 32 | x | ○ | Yes |
| 71 | 10 | 790 | 10 | 16.5 | 27.9 | 43.7 | 7 | ⊙ | ○ | No |
| 72 | 1 | 790 | 40 | 18 | 27.0 | 40.0 | 16 | ⊙ | ○ | No |
| 73 | 12 | 770 | 5 | 17 | 28.3 | 41.5 | 12 | ○ | ○ | No |
| 74 | | 770 | 15 | 17 | 27.5 | 43.1 | 8 | ⊙ | ○ | No |
| 75 | | 770 | 40 | 17 | 27.3 | 42.3 | 15 | ⊙ | ○ | No |
| 76 | 1 | 750 | 11 | 18 | 28.5 | 40.2 | 16 | ○ | ○ | No |
| 77 | | 750 | 40 | 18 | 27.6 | 40.1 | 16 | ⊙ | ○ | No |
| 78 | 9 | 740 | 18 | 19 | 28.1 | 42.5 | 12 | ○ | ○ | No |
| 79 | 4 | 720 | 40 | 15 | 28.5 | 40.3 | 15 | ○ | ○ | No |

EXAMPLE 5

Hot-rolled strips of alloy No. 1 and No. 4, which were used in Example 1, were employed. These strips were subjected to hot-rolled sheet annealing, cold-rolling, annealing, and finish cold-rolling to obtain alloy sheets of 0.25 mm thickness. The temperature of hot-rolled sheet annealing was 930° C. The annealing before finish cold-rolling was carried by holding the material at 890° C. for 1 min. The finish cold-rolling was conducted at 21% reduction ratio. The alloy sheets were etched to make flat masks were then treated by the annealing before press-forming under the condition given in Table 8 to obtain materials No. 80 through No. 82. The press-forming was applied to these flat masks after the annealing before press-forming, and the press-form quality was determined, which quality is given in Table 8. The measuring method for each property given in the table was the same as in Example 1. Etching performance was determined by visual observation of irregularity appeared on the etched flat masks.

Materials of No. 80 through No. 82 give chemical composition, condition of hot-rolling, austenite grain size before finish cold-rolling, finish cold-rolling reduction ratio, and condition of annealing before press-forming within the range specified in this invention. All these materials give favorable state without irregularity in etching, 16% or less of the degree of {211} plane, and 0.2% proof stress within the range specified in this invention. All of these materials show excellent press-form quality.

Therefore, it is important to keep the chemical composition, condition of hot-rolled sheet annealing, austenite grain size before finish cold-rolling, finish cold-rolling reduction ratio, and condition of annealing before press-forming within the range specified in this invention to obtain satisfactory press-form quality being aimed by this invention. If these conditions are satisfied, an alloy sheet subjected to etching after the annealing before press-forming gives a flat mask having the desired etching performance free of irregularity.

As described in detail in Example 1 through Example 5, the alloy sheets having higher than 16% of the degree of {211} plane give lower elongation perpendicular to rolling direction after the annealing before press-forming than that of the preferred embodiment of this invention. Increased degree of {211} plane presumably decreases the elongation and induces cracks on alloy sheet during press-forming.

According to this invention, the preferable press-form quality giving a high press-forming performance is obtained even under the condition of a low temperature of annealing before press-forming, as low as 720°–790° C., and the condition of a short annealing duration, as short as 40 min. or less. The preferable press-form quality includes excellent shape fixability during forming, favorable fitness to die, and suppression of crack generation. Furthermore, preferable etching quality and press-form quality are obtained even the annealing before press-forming is carried before the etching, which enables to eliminate the annealing before press-forming in a cathode ray tube manufacturer.

The presence of B and O within a specified range enhances the growth of crystal grains during the annealing before press-forming. The growth of grain yields the austenite grain having specified size, which then gives the shape fixability on press-forming. Also the presence of Si and N within a specified range suppresses the galling of die and improves the fitness to die on press-forming. By controlling the degree of {211} plane on a thin alloy sheet after the annealing before press-forming within a specified range, the crack generation during press-forming is suppressed. By keeping the degree of mixed grain for austenite grains after the annealing before press-forming within a specified range, the penetration irregularity during press-forming is suppressed. By maintaining the degree of {210} plane and {331} plane on the thin alloy sheet after the annealing before press-forming within a specified range, the partial color-phase shift is suppressed.

In the manufacturing process of the alloy of this invention, the hot-rolled strip is subjected to hot-rolled sheet annealing at a specific temperature before cold-rolling. Both cold-rolling and finish cold-rolling control their reduction ratio, and the annealing before press-forming controls the condition within each specified range. The average austenite grain size and degree of {331}, {210}, and {211} plane on the surface of alloy sheet are adjusted within specified range. To maintain the degree of mixed grain for austenite grains in the thin alloy sheet after the annealing before press-forming within a specified range, once or twice of cold-rolling after the annealing of hot-rolled sheet are conducted under a reduction ratio within a specified range.

The reason to limit the chemical composition in the thin Fe—Ni alloy sheet for shadow mask is the same as that given in the preferred embodiment-1 for the limitation of Ni, O, B, Si, and N.

The following is the reason of limitation on austenite grain size, degree of mixed grain for austenite grains, and degree of {331}, {210}, and {211} plane on the Fe—Ni alloy thin sheet for shadow mask after the annealing before press-forming.

TABLE 8

| Material No. | Alloy No. | Condition of annealing before press-forming: Temperature (°C.) | Condition of annealing before press-forming: Duration (min) | Austenite grain size before finish cold-rolling (μm) | Tensile property: 0.2% proof stress (kgf/mm²) | Tensile property: Elongation perpendicular to rolling direction (%) |
|---|---|---|---|---|---|---|
| 80 | 1 | 750 | 20 | 18 | 27.9 | 42.3 |
| 81 | | 790 | 2 | 18 | 28.5 | 41.0 |
| 82 | 4 | 720 | 40 | 15 | 28.5 | 40.3 |

| Material No. | Degree of {211} plane (%) | Press-form quality: Shape fix ability | Press-form quality: Fitness to die | Press-form quality: Crack generation on alloy sheet | Etching performance |
|---|---|---|---|---|---|
| 80 | 8 | ⊙ | ○ | No | Good, without irregularity |
| 81 | 16 | ○ | ○ | No | Good, without irregularity |
| 82 | 16 | ○ | ○ | No | Good, without irregularity |

Preferred Embodiment-2

According to this invention, favorable press-form quality is obtained and partial color-phase shift is suppressed by adjusting chemical composition, austenite grain size, degree of mixed grain for austenite grains, and orientation of crystals of thin Fe—Ni alloy sheet for shadow mask within the range specified in this invention.

The degree of mixed grain of austenite grains is defined by $\{|0.5\ Dmax-D|/D\}\times 100$ (%), where D is average austenite grain size in the alloy sheet, and Dmax is the maximum austenite grain size in the alloy sheet.

According to this invention, the required range of average austenite grain size in the case of warm press-forming is 15–45 μm to improve the shape fixability and to suppress crack generation during press-forming and to prevent the generation of penetration irregularity after the press-forming. Below 15 μm of the average austenite grain size results in a poor shape fixability to induce crack on alloy sheet. Above 45 μm of the average austenite grain size results in crack generation on the alloy surface and induces penetration irregularity after the press-forming. Accordingly, the average austenite grain size is defined in a range of 15–45 μm.

To suppress the crack generation on material, it is necessary to give the average austenite grain size within the range specified above and to control the degree of {211} plane at a specified value. To improve the grain growth under the condition of annealing before press-forming, this invention requests to control the content of O and B at or below specified value. To improve the fitness to die on press-forming, this invention requests to control the content of Si and N at or below specified value. The reason why the content of O, B, Si, and N is controlled is the same as in the preferred embodiment-1.

The Invar alloy for shadow mask in this invention contains a specified quantity of O, N, Si, and N within the basic structure of Fe—Ni alloy, has average austenite grain size after the annealing before press-forming within a range of 15–45 μm, has degree of mixed grain for austenite grains at or below 50%, has degree of {211} plane at or below 20%, has degree of {331} plane at or below 35%, and has degree of {210} plane at or below 35%. Most preferably, the alloy contains 0.0001–0.004% of C, 0.001–0.35% of Mn, 0.001–0.05% of H, and 1 ppm or less of H, in addition to Ni, Si, B, and O.

Through the control of chemical composition and of average austenite grain size after the annealing before press-forming within the range specified in this invention, it is possible to suppress galling of die during press-forming and to bring the shape fixability to a superior level. Regarding the press-form quality, however, there remains the problem of crack generation. To solve the problem, the inventors investigated the relation between the crystal orientation of an alloy having chemical composition and crystal grain size within the range specified in this invention and the crack generation during press-forming, and found that an effective means to suppress the crack generation on the alloy of this invention is to control both average austenite grain size after the annealing before press-forming and the degree of {211} plane not exceeding each specified value.

Figure 6:
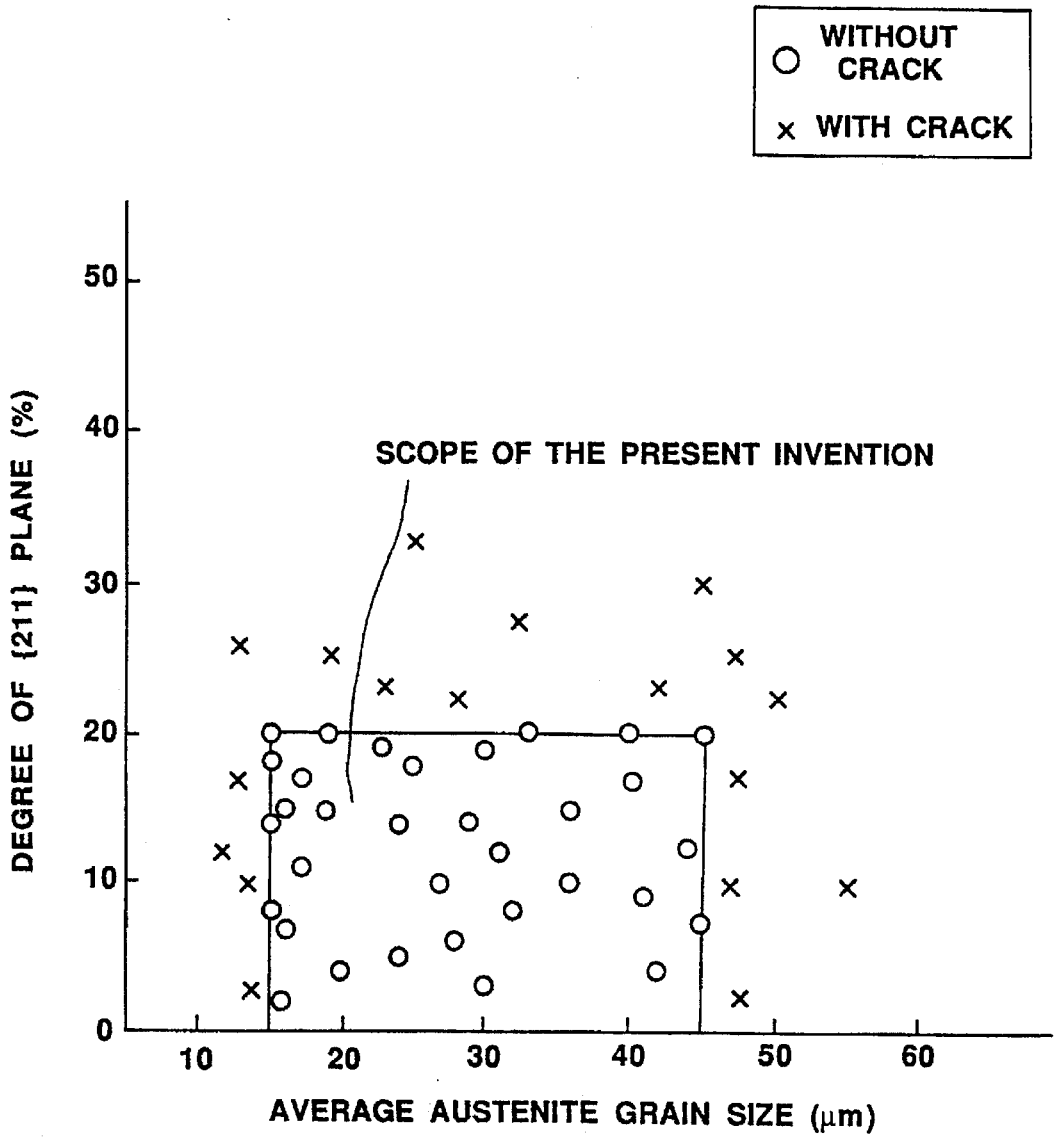
FIG. 6 shows the relation among crack generation during press-forming, degree of {211} plane, and average austenite grain size after the annealing before press-forming, being described in the preferred embodiment-2.

FIG. 6 shows the relation among crack generation during press-forming, degree of {211} plane, and average austenite grain size. The alloy sheet contains 34–38 wt. % of Ni, 0.0005 wt. % or less of B, and 0.002 wt. % or less of O. The alloy shows 50% or less of the degree of mixed grain for austenite grains, 35% or less of the degree of {331} plane, 16% or less of {210} plane. The white circles in FIG. 6 correspond to no-crack of x mark correspond to crack generation. The degree of {211} plane is determined from the relative X-ray intensity ratio of (422) diffraction plane of alloy sheet after the annealing before press-forming divided by the sum of relative X-ray intensity ratio of (111), (200), (220), (311), (331), (420), and (422) diffraction planes. The degree of {211} plane is determined from the measurement of X-ray diffraction intensity of (422) diffraction plane which has equivalent orientation with (211) plane.

The relative X-ray diffraction intensity ratio is defined as the value of X-ray diffraction intensity measured on each diffraction plane divided by the theoretical X-ray intensity of that diffraction plane. For example, the relative X-ray intensity ratio of (111) diffraction plane is the value of X-ray diffraction intensity of (111) plane divided by the theoretical X-ray diffraction intensity of (111) diffraction plane. The degree of (331) plane is determined from the relative X-ray diffraction intensity ratio of (331) diffraction plane divided by the sum of the relative X-ray diffraction intensity ratio of seven planes, (111) to (422). The degree of {210} plane is determined from the relative X-ray diffraction intensity ratio of (420) diffraction plane which has equivalent orientation with (210) plane divided by the sum of relative X-ray diffraction intensity ratio of seven planes, (111) to (422).

As shown in FIG. 6, in the cases that the average austenite grain size is in a range of 15–45 μm and that the degree of {211} plane is 20% or below, no crack on alloy sheet nor penetration irregularity appears, and excellent effect of this invention is achieved. Consequently, this invention specifies the condition of 20% or less for the degree of {211} plane to suppress crack generation on alloy sheet.

Figure 7:
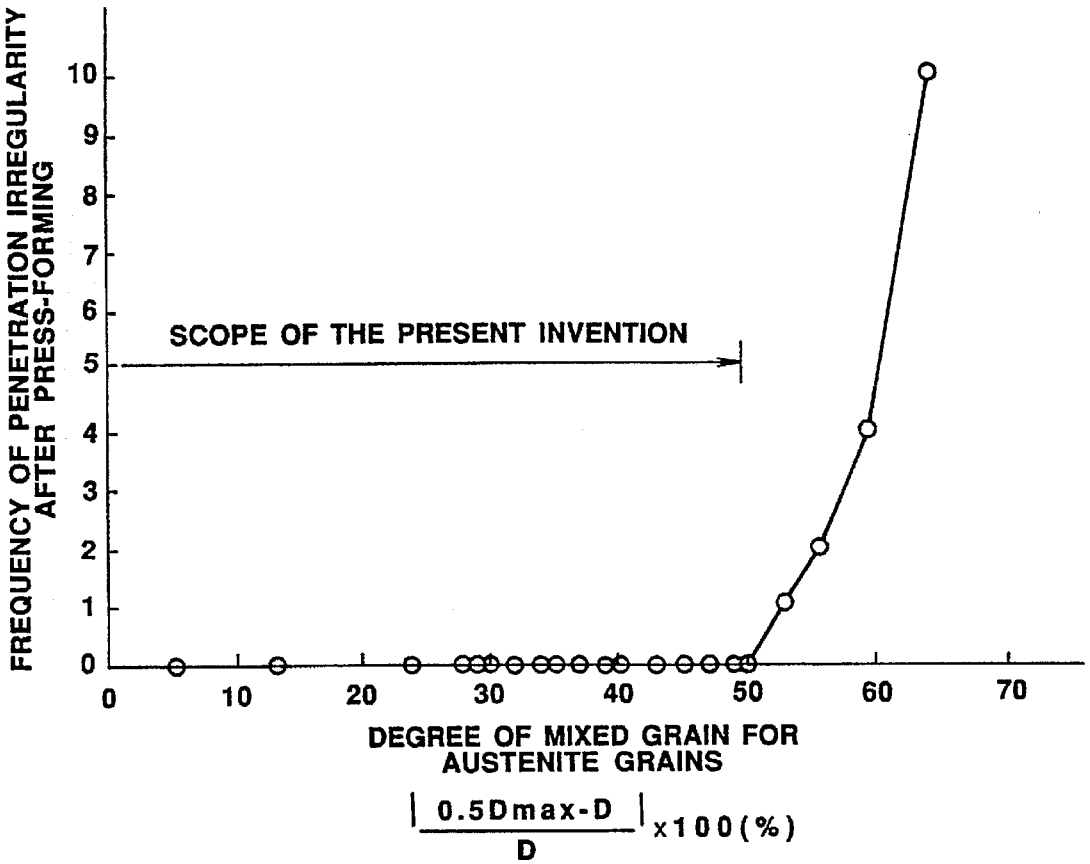
FIG. 7 shows the relation between frequency of penetration irregularity after press-forming and degree of mixed grain for austenite grains after the annealing before press-forming, being described in the preferred embodiment-2.

Prevention of penetration irregularity during press-forming requires the control of degree of mixed grain for austenite grain after the annealing before press-forming. FIG. 7 shows the relation between frequency of penetration irregularity after press-forming and degree of mixed grain for austenite grains after the annealing before press-forming. The alloy contains 34–38 wt. % of Ni, 0.05 wt. % or less of Si, 0.0005 wt. % of less of B, 0.0015 wt. % or less of N, and 0.002 wt. % or less of O. The alloy shows 35% or less of the degree of {331} plane, 16% or less of {210} plane, and 20% or less of {211} plane. FIG. 7 shows that the degree of mixed grain for austenite grains exceeding 50% increases the frequency of the generation of penetration irregularity. Consequently, this invention specifies 50% or less for the degree of mixed grain for austenite grains to suppress the generation of penetration irregularity after press-forming.

As described above, the specified range for the content of O, B, Si, and N, the average austenite grain size after the annealing before press-forming, and the degree of {211} plane for the alloy of this invention provide the press-form quality aimed in this invention.

To suppress partial color-phase shift, control of the degree of {331} plane and {210} plane after the annealing before press-forming is important. If the degree of {331} plane exceeds 35% after the annealing before press-forming, or if the degree of {210} plane exceeds 16% after the annealing before press-forming, then partial color-phase shift occurs. Consequently, this invention specifies 35% or less for the degree of {331} plane and 16% or less for the degree of {210} plane.

To maintain the degree of {331} plane, {210} plane, and {211} plane after the annealing before press-forming at 35% or less, 16% or less, and 20% or less, respectively, the production conditions which do not aggregate the {331} plane, {210} plane, and {211} plane as far as possible during the thin alloy sheet-making process are adopted covering from solidification, hot-working, cold-working, to annealing steps.

Ingot or continuous-casted slab undergoes slabbing and hot-rolling to form a hot-rolled strip. The hot-rolled strip is then subjected to hot-rolled sheet annealing, cold-rolling, recrystallization, finish cold-rolling, strain-relief annealing, annealing before press-forming, and blackening treatment. Adequate hot-rolled sheet annealing is effective to prevent the aggregation of {331} plane, {210} plane, and {211} plane. By selecting a suitable hot-rolled sheet annealing temperature in a range of 810°–890° C., the degree of each {331}, {210}, and {211} plane is kept at or below the upper limit specified in this invention. Consequently, this invention specifies the temperature of hot-rolled sheet annealing in a range of 810°–890° C. to achieve the degree of {331} plane at 35% or below, the degree of {210} plane at 16% or below, and the degree of {211} plane at 20% or below.

The effect of the hot-rolled sheet annealing of this invention is performed when the hot-rolled strip of this invention is fully crystallized before hot-rolled sheet annealing. To obtain the level of the degree of {331} plane, {210} plane, and {211} plane aimed in this invention, a uniform heat treatment of the slab after slabbing is not favorable. For example, when the heat treatment is carried at 1200° C. or higher temperature and 10 hours or longer duration, at least one of the degree of {331} plane, {210} plane, and {211} plane exceeds the upper limit of this invention. Therefore, such a uniform heat treatment must be avoided.

Manufacturing thin alloy sheet from the hot-rolled strip described above requires the optimization of cold-rolling and annealing conditions, finish cold-rolling condition, strain-relief annealing condition, and condition of annealing before press-forming, and limiting the degree of {331} plane, {210} plane, and {211} plane within the range specified in this invention to obtain a degree of mixed grain for austenite grains within the range specified in this invention.

Figure 8:
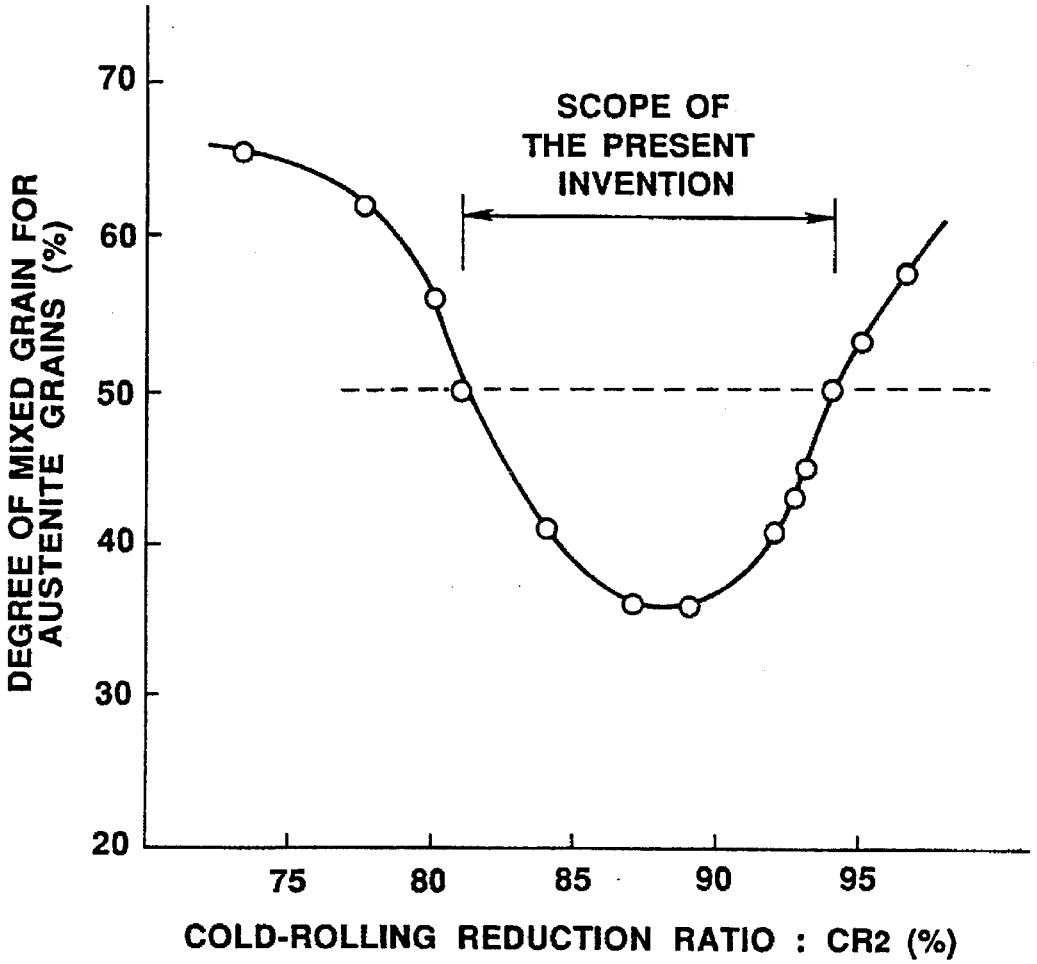
FIG. 8 shows the relation between cold-rolling reduction ratio and degree of mixed grain for austenite grains after the annealing before press-forming, being described in the preferred embodiment-2.

The optimization of the condition of cold-rolling and annealing after the hot-rolled sheet annealing is important for the control of degree of mixed grain for austenite grains after the annealing before press-forming. FIG. 8 shows the relation between the cold-rolling reduction ratio (CR2%) for one cycle of cold-rolling and annealing after the annealing of hot-rolled sheet and the degree of mixed grain for austenite grain after the annealing before press-forming. The alloy employed contained 34–38 wt. % of Ni, 0.05 wt. % or less of Si, 0.0005 wt. % or less of B, 0.0015 wt. % or less of N, and 0.002 wt. % or less of O. The hot-rolled strip having the composition was treated by annealing at 810°–890° C., cold-rolling (CR2), finish cold-rolling at a reduction ratio of 16–29%, strain-relief annealing at 450°–540° C. for 0.5–300 sec., and annealing before press-forming at a temperature and duration specified in this invention to form an alloy sheet. The prepared alloy sheet had 35% or lower degree of {331} plane, 16% or lower degree of {210}plane, and 20% or lower degree of {211} plane, and had 15–45 μm of average austenite grain size after the annealing before press-forming.

FIG. 8 indicates that the case of one cycle cold-rolling and annealing and of 81–94% for cold-rolling reduction ratio (CR2) gives 50% or lower degree of mixed grain for austenite grains within the range of this invention. The case that the cold-rolling reduction ratio (CR2) is below 81% or above 91% gives above 50% of the degree of mixed grain for austenite grains. Consequently, this invention specifies 81–94% of cold-rolling reduction ratio (CR2) to keep the degree of mixed grain for austenite grains for one cycle cold-rolling and annealing.

Figure 9:
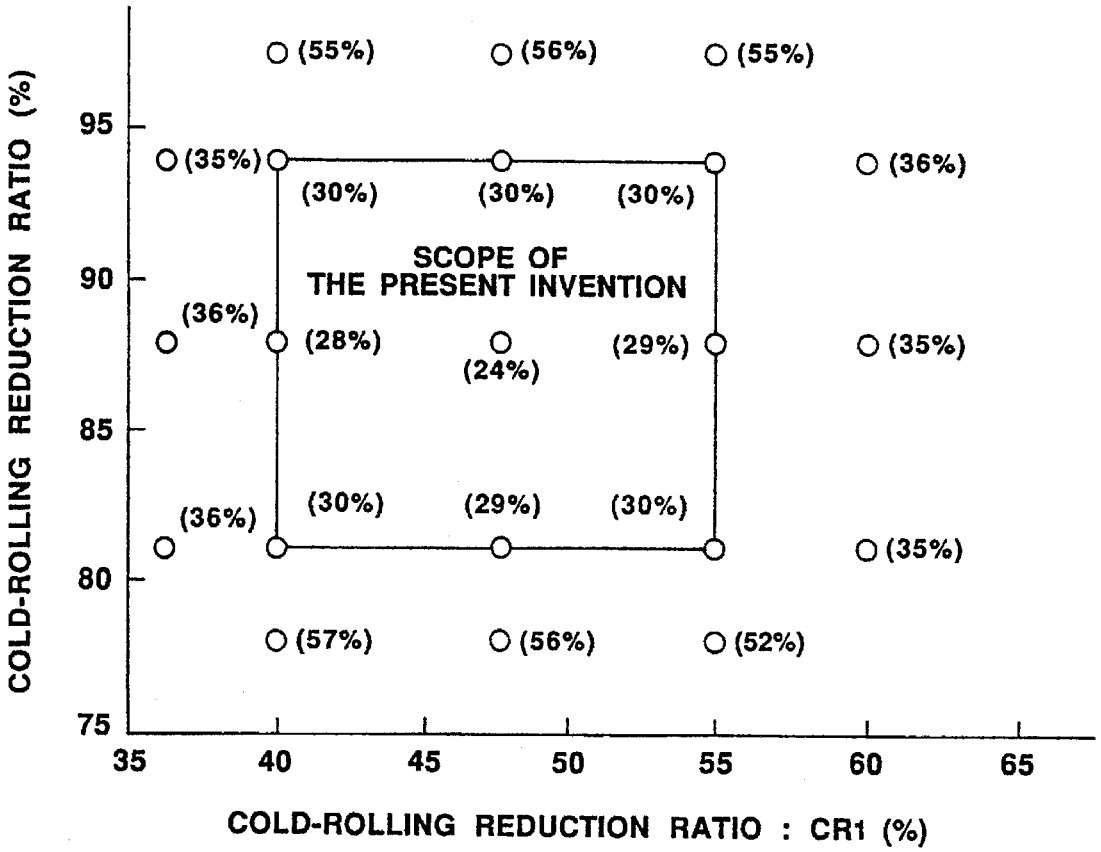
FIG. 9 shows the relation between cold-rolling reduction ratio and degree of mixed grain for austenite grains after the annealing before press-forming, being described in the preferred embodiment-2.

FIG. 9 shows the relation between the cold-rolling reduction ratio for two cycles of cold-rolling and annealing after the annealing before press-forming and the degree of mixed grain for austenite grain after the annealing before press-forming. The alloy employed contained 34–38 wt. % of Ni, 0.05 wt. % or less of Si, 0.0005 wt. % or less of B, 0.0015 wt. % or less of N, and 0.002 wt. % or less of O. The hot-rolled strip having the composition was treated by annealing at 810°–890° C., primary cold-rolling (CR1), recrystallization annealing, secondary cold-rolling (CR2), recrystallization annealing, finish cold-rolling at a reduction ratio of 16–29%, strain-relief annealing at 450°–540° C. for 0.5–300 sec., and annealing before press-forming at a temperature and duration specified in this invention to form an alloy sheet. The prepared alloy sheet had 35% or lower degree of {331} plane, 16% or lower degree of {210} plane, and 20% or lower degree of {211} plane, and had 15–45 μm of average austenite grain size after the annealing before press-forming.

FIG. 9 indicates that the case of 81–94% for secondary cold-rolling reduction ratio (CR2) and 40–55% for primary cold-rolling reduction ratio (CR1) gives favorable degree of mixed grain for austenite grains. Consequently, this invention specifies 40–55% of primary cold-rolling reduction ratio (CR1) and 81–94% of secondary cold-rolling reduction ratio (CR2) to keep the degree of mixed grain for austenite grains for two cycle cold-rolling and annealing.

Preferable condition of each recrystallization after primary cold-rolling and secondary cold-rolling is 810°–840° C. and 0.5–3 min. Even when the annealing temperature is at or above the temperature of recrystallization, the annealing below 810° C. gives a mixed grain structure, so the state after the annealing before press-forming increases the degree of mixed grain for austenite grains. Even the annealing is carried at a temperature range of 810° C.–840° C., the duration of shorter than 0.5 min. of annealing gives a mixed grain structure, and an annealing over 3 min. also gives a mixed grain structure. On both cases, the quality of alloy sheet is not preferable because the degree of mixed grain for austenite grains increases after the annealing before press-forming. Following the conditions of cold-rolling and annealing described thereabove, the degree of {331} plane, {210} plane, and {211} plane becomes to 35% or less, 16% or less, and 20% or less, respectively.

When the finish cold-rolling reduction ratio is in a range of 16–29%, and when the composition, condition of cold-rolling and annealing, and condition of annealing before press-forming are kept within the range specified in this invention, the alloy sheet after the annealing before press-forming gives 15–45 μm of average austenite grain size, 50% or lower degree of mixed grain for austenite grain, 35% or less of the degree of {331} plane, 16% or less of {210} plane, and 20% or less of {211} plane after the annealing before press-forming. When the cold-rolling reduction ratio is less than 16% or higher than 29%, at least one of the characteristics of this invention is not satisfied. Therefore, the range of finish cold-rolling is specified in a range of 16–29%.

Figure 10:
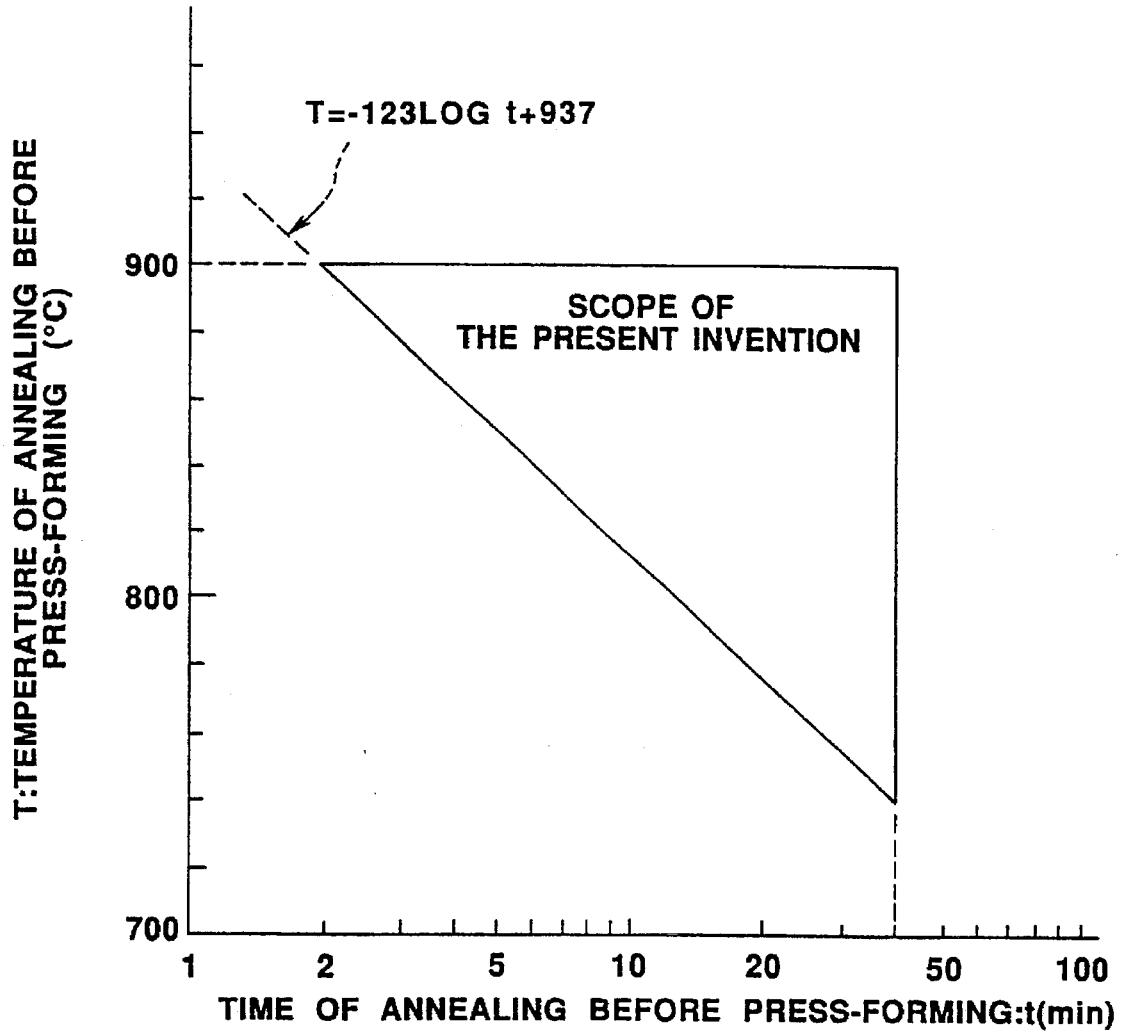
FIG. 10 shows the relation among average austenite grain size after the annealing before press-forming, degree of mixed grain for austenite grains, degree of crystal planes {331}, {210}, and {211}, and the condition of annealing before press-forming, being described in the preferred embodiment-2.
Figure 11:
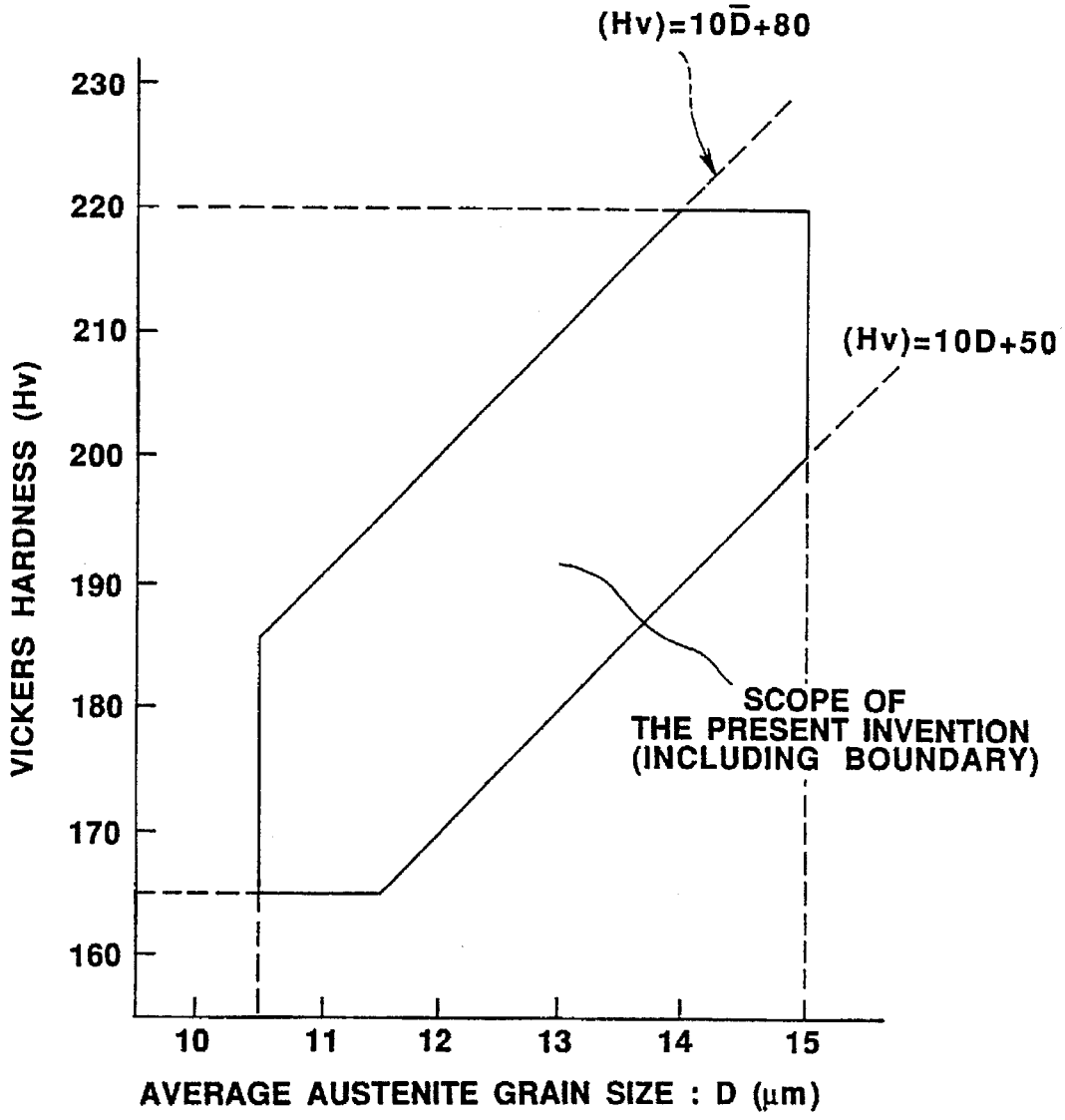
FIG. 11 shows the relation between average austenite grain size and Vickers hardness, being described in the preferred embodiment-3.

According to this invention, the condition of annealing before press-forming is also important to keep the degree of mixed grain for austenite grains, degree of {331} plane, {210} plane, and {211} plane within the range specified in this invention. FIG. 10 shows the relation among average austenite grain size after the annealing before press-forming, degree of mixed grain for austenite grain, degree of crystal planes {331}, {210}, and {211}, and the temperature (T°C.) and duration (t min.) of annealing before press-forming. The alloy employed contained 34–38 wt. % of Ni, 0.05 wt. % or less of Si, 0.0005 wt. % or less of B, 0.0015 wt. % or less of N, and 0.002 wt. % or less of O. The hot-rolled alloy strip having the composition was treated by annealing at 810°–890° C., cold-rolling under the condition specified in this invention, finish cold-rolling at a reduction ratio of 16–29%, strain-relief annealing at 450°–540° C. for 0.5–300 sec., and annealing before press-forming at a temperature and duration specified in this invention to form an alloy sheet.

As clearly seen in FIG. 10, even when all the conditions except that for the annealing before press-forming are kept within the range specified in this invention, if the condition of $$T<-123 \log t+937$$

is satisfied, then the average austenite grain size is below 15 μm and the degree of {211} plane exceeds 20%, which are inadequate. If the temperature (T°C.) of annealing before press-forming exceeds 900° C., then the average austenite grain size exceeds 45 μm, and the degree of {211} plane exceeds 20%, which are also inadequate. If the duration (t min.) of annealing before press-forming exceeds 40 min., then at least one of the degree of {331} plane, {210} plane, and {211} plane does not satisfy the specified limit of this invention, which is inadequate.

Therefore, as the condition to obtain average austenite grain size, degree of mixed grain for austenite grains, and degree of {331} plane, {210} plane, and {211} plane within the range specified in this invention, this invention specifies the temperature (T°C.) of annealing before press-forming in a range of 740°–900° C., the duration of annealing before press-forming in a range of 2–40 min., and the relation of [T≧−123 log t+937]. The strain-relief annealing in this invention is important to control the degree of {331} plane, {210} plane, and {211}plane during the succeeding step of annealing before press-forming. The condition of strain-relief annealing to fully perform the effect of this invention is 450°–540° C. and 0.5–300 sec.

The other methods to keep the degree of {331} plane, {210} plane, and {211} plane on the thin alloy sheet within the range of this invention after the annealing before press-forming include the quenching solidification process or the comprehensive structure control through the control of recrystallization in hot-working. In addition, the annealing before press-forming in this invention may be applied before the photo-etching. In that case, the desired quality of photo-etching is assured if the condition of annealing before press-forming satisfies the limit of this invention.

EXAMPLE-6

A series of ladle refining produced alloy ingots of No. 1 through No. 21 having the composition listed in Table 9. These ingots were subjected to slabbing, surface scaring, and hot-rolling to provide hot-rolled strips. The heating condition in hot-rolling was 110° C. for 3 hours. The hot-rolled strips were annealed at 860° C. After annealing, the annealed and hot-rolled strips were subjected to cold-rolling at 93.0% reduction ratio, annealing at 810° C. for 1 min., finish cold-rolling at 21% reduction ratio, and strain-relief annealing at 530° C. for 5 sec. to obtain alloy sheets having 0.25 mm of thickness. The hot-rolled strips were sufficiently crystallized after annealing.

Among the obtained materials No. 1 through No. 21, the materials of No. 1 through No. 3 and of No. 5 through No. 21 were etched to make flat masks. The flat masks were treated by annealing before press-forming followed by press-forming under the condition given in Table 11, which were then tested for shape fix ability, fitness to die, crack generation on material, and penetration irregularity. Regarding the shape fixability, evaluation grades included very good (◎), good (603 ), rather poor (Δ), and bad (x). For the fitness to die, evaluation grades included good without ironing mark (○), rather poor with minor ironing mark (Δ), and lots of ironing marks (x). The above listed flat masks showed no irregularity after etching, and they were confirmed to satisfy the requested etching performance. Average austenite grain size and degree of mixed grain for austenite grain were examined after the annealing before press-forming. The tensile properties, "n" value, "r" value, and elongation, and the degree of {331} plane, {210} plane, and {211} plane were determined after the annealing before press-forming. The tensile properties were measured at ambient temperature. The degree of {331} plane, {210} plane, and {211} plane was determined by X-ray diffraction method.

Alloy sheet No. 4 was subjected to strain-relief annealing under the condition described thereabove, annealing before press-forming, and etching to prepare flat mask. The flat mask was then press-formed. The characteristics of this material were also determined using the same procedure as in the above case. Partial color-phase shift was determined after blackening the press-formed shadow mask, assembling the shadow mask into a cathode ray tube, and irradiating electron beam for a predetermined time.

As clearly indicated in Table 9 and Table 10, the materials of No. 1 through No. 13, which have the degree of {331} plane, {210} plane, and {211} plane, average austenite grain size, and degree of mixed grain for austenite grain within the range specified in this invention, show excellent press-form quality without generating color-phase shift. Material No. 4 was treated by etching after the annealing before press-forming, and showed no irregularity on flat mask and gave sufficient etching performance.

On the contrary, material No. 14 gives Si content above the upper limit of this invention, and material No. 16 gives N content above the upper limit of this invention, both of which have a problem on the fitness to die. Material No. 15 gives O content above the upper limit of this invention, and gives average austenite grain size below the lower limit of this invention, and showed a poor shape fixability and crack generation on the alloy sheet. Also the material No. 15 gives degree of mixed grain for austenite grain above the limit of this invention, generates penetration irregularity and has problem on press-form quality.

Material No. 17 gives B content above the upper limit of this invention, and material No. 18 gives both B and O content above the upper limit of this invention, gives average austenite grain size below 15 μm, and is poor in shape fixability. Furthermore, materials No. 17 and No. 18 give degree of mixed grain for austenite grains above 50% to induce penetration irregularity. They also give degree of {211} plane above 20%, and generate cracks on alloy sheet, and have problem on press-form quality.

Material No. 19 gives degree of {211} plane above the upper limit of this invention, and material No. 20 gives degree of {331} plane above the upper limit of this invention. Both materials induce partial color-phase shift and have problem on screen quality. Material No. 21 gives average austenite grain size above 45 μm, generates cracks on alloy sheet and penetration irregularity, and has problem on press-form quality. The material No. 21 also gives degree of {211} plane above 20%, which crystal orientation increases its degree with the increase of average grain size under the condition of annealing before press-forming, 920° C. and 40 min.

As clearly described above, a thin alloy sheet which has excellent press-form quality and screen quality is obtained by controlling the composition, degree of {331} plane, {210} plane, and {211} plane, average grain size, and degree of mixed grain within the range specified in this invention.

TABLE 9

| Material No. | Alloy No. | Chemical composition Ni (%) | Si (%) | O (%) | N (%) | B (%) | C (%) | Mn (%) | Cr (%) | H (ppm) | Average austenite grain size after the annealing before press-forming (μm) | Degree of mixed grain for austenite grains after the annealing before press-forming |
|---|---|---|---|---|---|---|---|---|---|---|---|---|
| 1 | 1 | 35.9 | 0.005 | 0.0010 | 0.0008 | 0.00005 | 0.0013 | 0.25 | 0.01 | 1.0 | 30 | 40 |
| 2 | 2 | 36.1 | 0.02 | 13 | 10 | 0.0001 | 11 | 0.26 | 2 | 0.2 | 36 | 35 |
| 3 | 3 | 36.0 | 0.03 | 14 | 11 | 0.0001 | 15 | 0.04 | 2 | 0.8 | 32 | 35 |
| 4 | 4 | 36.5 | 0.04 | 20 | 15 | 0.0005 | 0.0040 | 0.35 | 2 | 1.0 | 15 | 34 |
| 5 | 5 | 35.8 | 0.01 | 15 | 10 | 0.0002 | 23 | 0.25 | 5 | 0.9 | 16 | 32 |
| 6 | 6 | 35.7 | 0.01 | 12 | 9 | 0.0001 | 20 | 0.27 | 1 | 0.9 | 17 | 42 |
| 7 | 7 | 36.0 | 0.02 | 8 | 7 | 0.0002 | 9 | 0.11 | 3 | 0.7 | 19 | 38 |
| 8 | 8 | 36.2 | 0.05 | 5 | 5 | 0.0001 | 7 | 0.05 | 2 | 0.9 | 20 | 37 |
| 9 | 9 | 36.2 | 0.001 | 2 | 2 | 0.0001 | 5 | 0.005 | 1 | 0.6 | 23 | 35 |
| 10 | 10 | 35.5 | 0.04 | 18 | 11 | 0.0001 | 32 | 0.01 | 1 | 0.6 | 40 | 47 |
| 11 | 11 | 35.8 | 0.03 | 16 | 12 | 0.0002 | 30 | 0.20 | 2 | 0.3 | 27 | 34 |
| 12 | 12 | 35.0 | 0.05 | 19 | 15 | 0.0004 | 39 | 0.15 | 3 | 0.2 | 45 | 45 |
| 13 | 13 | 36.0 | 0.01 | 17 | 12 | 0.0001 | 37 | 0.05 | 4 | 0.5 | 42 | 40 |
| 14 | 14 | 35.6 | 0.08 | 20 | 14 | 0.0002 | 21 | 0.28 | 3 | 1.1 | 18 | 50 |
| 15 | 15 | 36.2 | 0.05 | 35 | 12 | 0.0001 | 17 | 0.31 | 4 | 1.1 | 13 | 60 |
| 16 | 16 | 36.3 | 0.04 | 18 | 20 | 0.0002 | 19 | 0.25 | 3 | 1.3 | 19 | 49 |
| 17 | 17 | 35.0 | 0.04 | 17 | 15 | 0.0011 | 25 | 0.28 | 4 | 1.2 | 12 | 55 |
| 18 | 18 | 35.8 | 0.05 | 23 | 16 | 0.0021 | 32 | 0.27 | 4 | 1.3 | 14 | 63 |
| 19 | 13 | 36.0 | 0.01 | 17 | 12 | 1 | 37 | 0.05 | 4 | 0.5 | 20 | 45 |
| 20 | 13 | 36.0 | 0.01 | 17 | 12 | 1 | 37 | 0.05 | 4 | 0.5 | 24 | 43 |
| 21 | 13 | 36.0 | 0.01 | 17 | 12 | 1 | 37 | 0.05 | 4 | 0.5 | 50 | 50 |

TABLE 10

| Material No. | Alloy No. | Degree of crystal plane on the surface of alloy sheet (%) (331) | (210) | (211) | Mechanical property after the annealing before press-forming n value | r value | Elongation (%) | Press-form quality Shape fix ability | Fitness to die | Crack generation on alloy sheet | Frequency of penetration irregularity | Partial color-phase shift |
|---|---|---|---|---|---|---|---|---|---|---|---|---|
| 1 | 1 | 23 | 12 | 19 | 0.33 | 0.92 | 42.0 | ◎ | ○ | No | 0 | No |
| 2 | 2 | 20 | 10 | 15 | 0.34 | 0.94 | 42.1 | ◎ | ○ | No | 0 | No |
| 3 | 3 | 18 | 9 | 8 | 0.33 | 0.95 | 42.3 | ◎ | ○ | No | 0 | No |
| 4 | 4 | 14 | 5 | 20 | 0.30 | 0.92 | 41.9 | ○ | ○ | No | 0 | No |
| 5 | 5 | 19 | 13 | 7 | 0.30 | 0.93 | 42.7 | ○ | ○ | No | 0 | No |
| 6 | 6 | 17 | 11 | 17 | 0.30 | 0.94 | 42.2 | ○ | ○ | No | 0 | No |
| 7 | 7 | 22 | 9 | 20 | 0.31 | 0.92 | 41.0 | ○ | ○ | No | 0 | No |
| 8 | 8 | 12 | 10 | 4 | 0.31 | 0.95 | 43.2 | ○ | ○ | No | 0 | No |
| 9 | 9 | 11 | 10 | 19 | 0.32 | 0.95 | 40.9 | ○ | ○ | No | 0 | No |
| 10 | 10 | 27 | 7 | 20 | 0.35 | 0.95 | 41.0 | ◎ | ○ | No | 0 | No |
| 11 | 11 | 12 | 6 | 10 | 0.33 | 0.97 | 42.5 | ◎ | ○ | No | 0 | No |
| 12 | 12 | 30 | 15 | 20 | 0.36 | 1.20 | 40.9 | ◎ | ○ | No | 0 | No |
| 13 | 13 | 26 | 13 | 4 | 0.35 | 1.05 | 43.0 | ◎ | ○ | No | 0 | No |
| 14 | 14 | 18 | 4 | 12 | 0.29 | 0.85 | 40.0 | ○ | x | No | 0 | No |
| 15 | 15 | 22 | 13 | 17 | 0.29 | 0.80 | 38.5 | x | ○ | Yes | 4 | — |
| 16 | 16 | 26 | 10 | 15 | 0.29 | 0.88 | 40.0 | ○ | x | No | 0 | No |
| 17 | 17 | 19 | 13 | 31 | 0.28 | 0.70 | 36.3 | x | ○ | Yes | 2 | — |
| 18 | 18 | 18 | 12 | 33 | 0.27 | 0.81 | 35.0 | x | ○ | Yes | 6 | — |
| 19 | 13 | 34 | 21′ | 20 | 0.30 | 0.90 | 40.1 | ○ | ○ | No | 0 | Yes |
| 20 | 13 | 37 | 15 | 20 | 0.30 | 0.90 | 40.2 | ○ | ○ | No | 0 | Yes |
| 21 | 13 | 30 | 13 | 22 | 0.27 | 0.88 | 33.0 | ○ | ○ | Yes | 5 | No |

TABLE 11

| Material No. | Temperature of hot-rolled sheet: annealing (°C.) | Condition of annealing before press-forming T: Temperature (°C.) | t: Duration (min) |
|---|---|---|---|
| 1 | 860 | 830 | 30 |
| 2 | " | 850 | 40 |
| 3 | " | 870 | 15 |
| 4 | " | 880 | 3 |
| 5 | " | 750 | 40 |
| 6 | " | 790 | 25 |
| 7 | " | 760 | 40 |
| 8 | " | 820 | 20 |
| 9 | " | 830 | 15 |
| 10 | " | 870 | 40 |
| 11 | " | 840 | 20 |
| 12 | " | 900 | 40 |
| 13 | " | 890 | 30 |
| 14 | " | 760 | 40 |
| 15 | " | " | " |
| 16 | " | " | " |
| 17 | " | 760 | 40 |
| 18 | " | " | " |
| 19 | 800 | 770 | 40 |
| 20 | 920 | 790 | 40 |
| 21 | 860 | 920 | 40 |

EXAMPLE-7

Hot-rolled sheets of No. 1 through No. 13, which were used in Example-6, were employed to treat annealing and cold rolling at the reduction ratio under the condition given in Table 12. The materials of blank $CR_1$ column in the table indicate that they were cold-rolled for only once under the reduction ratio given in the table. The materials having both $CR_1$ and $CR_2$ columns indicate that they were subjected to two times of cold-rolling under each reduction ratio given in the table. After the cold-rolling, they were treated by annealing at 810° C. for 1 min. and by finish cold-rolling at the reduction ratio ($CR_3$) given in the table. After completing the finish cold-rolling, they were treated by strain-relief annealing at 530° C .for 6.5 sec. to obtain alloy sheet of No. 2 through No. 46, each having 0.25 mm of thickness.

Materials of No. 22 through No. 39, No. 41, No. 42, and No. 44 through No. 46 were etched to make flat masks. Those flat masks were treated by annealing before press-forming under the condition given in Table 12 and by press-forming. The press-formed flat masks were inspected for the press-form quality and color-phase shift, which result is given in Table 13. The method for measurement of each characteristic in Table 12 and Table 13 is the same that in Example-6. It was confirmed that the flat masks after etched had no irregularity and had satisfactory etching characteristics.

Materials of No. 40 and No. 43 were subjected to strain-relief annealing and to annealing before press-forming under the condition given in Table 12, to etching to make flat masks, then to press-forming.

Materials of No. 31 through No. 46 have the composition, hot-rolled sheet annealing condition, cold-rolling condition, finish cold-rolling reduction ratio, condition of annealing before presS-forming, degree of {331} plane, {210} plane, and {211} plane, average grain size, and degree of mixed grain within the range specified in this invention. As clearly shown in Table 13, these materials of No. 31 through No. 46 have excellent press-form quality and give no partial color-phase shift. Materials of No. 40 and No. 43 were subjected to etching after the annealing before press-forming, and they gave no irregularity on flat masks to give sufficient etching characteristics.

Materials of No. 32, No. 35 through No. 37, No. 39, and No. 43 through No. 45 were treated by two times of cold-rolling. Since the primary cold-rolling was conducted under 40–55% of reduction ratio, they give lower and more favorable degree of mixed grain than that of materials treated by one cycle cold-rolling. Materials of once-cold-rolling are No. 31, No. 33 through No. 34, No. 38, No. 40 through No. 42, and No. 46.

Material No. 22 gives temperature of hot-rolled sheet annealing below the lower limit of this invention and gives degree of {210} plane above the upper limit of this invention. The material generates partial color-phase shift and raises problem of screen quality. Material No. 23 gives temperature of hot-rolled sheet annealing above the upper limit of this invention and gives degree of {211} plane above the upper limit of this invention. The material generates crack on alloy sheet to induce problem of press-form quality.

Material No. 24 gives cold-rolling reduction ratio ($CR_2$%) above the upper limit of this invention, and material No. 25 gives cold-rolling reduction ratio ($CR_2$%) below the lower limit of this invention. Both materials give degree of mixed grain above the upper limit of this invention, generate penetration irregularity, and induce problem of press-form quality.

Material No. 26 gives finish cold-rolling reduction ratio ($CR_3$) above the upper limit of this invention. The material also gives average austenite grain size below the lower limit of this invention and induces problem of shape fixability to generate cracks on alloy sheet. Material No. 27 gives finish cold-rolling reduction ratio ($CR_3$) below the lower limit of this invention. The material also gives degree of mixed grain above the upper limit of this invention to induce penetration irregularity. Furthermore, the material No. 27 gives degree of {211} plane above the upper limit of this invention to generate crack on alloy sheet. The material also gives degree of {210} plane above the upper limit of this invention to induce partial color-phase shift.

Material No. 28 gives temperature (T) of annealing before press-forming above the upper limit of this invention. Material No. 29 gives duration (t) of annealing before press-forming above the upper limit of this invention. Material No. 30 gives the value oft lower than [−123 log t+937]. Material No. 28 gives degree of mixed grain above the upper limit of this invention to generate penetration irregularity. The material also gives degree of {211} plane above the upper limit of this invention to generate crack on alloy sheet. Material No. 29 gives degree of {211} plane above the upper limit of this invention to generate crack on alloy sheet. The material also gives degree of {331} plane above the upper limit of this invention to induce partial color-phase shift. Material No. 30 gives average grain size below the lower limit of this invention and has problem of shape fixability. The material also gives degree of {211} plane above the upper limit of this invention to generate crack on alloy sheet.

As detailed thereabove, the press-form quality and screen quality intended by this invention are obtained by keeping the composition, condition of hot-rolled sheet annealing, cold-rolling condition, finish cold-rolling reduction ratio, and condition of annealing before press-forming within the range specified in this invention. As in the cases of No. 4, No. 40, and No. 43, even if a Fe—Ni alloy thin sheet having satisfactory press-form quality and giving no color-phase shift is etched, the obtained flat mask gives no irregularity and gives favorable etching performance.

As Example-6 and Example-7 clearly show, in the case that degree of {211} plane exceeds 20% or that average grain size does not satisfy the specified limit of this invention, the elongation, "n" value, and "r" value after the annealing before press-forming are low compared with those in preferred embodiment of this invention. The phenomenon is presumably caused by that an average grain size out of the range of this invention degrades those characteristics, which then induces crack on alloy sheet during press-forming.

TABLE 12

| Material No. | Alloy No. | Temperature of hot-rolled sheet annealing (°C.) | Cold-rolling reduction ratio $CR_1$ % | Cold-rolling reduction ratio $CR_2$ % | Finish cold-rolling reduction ratio $CR_3$ % | Condition of the annealing before press-forming T: Temperature (°C.) | Condition of the annealing before press-forming t: Duration (min) | Average austenite grain size after the annealing before press-forming (μm) | Degree of mixed grain for average austenite grains after the annealing before press-forming (%) | Degree of crystal plane on the surface of alloy sheet (%) (331) | (210) | (211) |
|---|---|---|---|---|---|---|---|---|---|---|---|---|
| 22 | 1 | 800 | — | 93 | 21 | 850 | 30 | 33 | 47 | 35 | 23 | 20 |
| 23 | 2 | 900 | — | 93 | " | 810 | 40 | 28 | 45 | 32 | 10 | 22 |
| 24 | 6 | 860 | — | 95 | " | 830 | 10 | 15 | 53 | 27 | 12 | 14 |
| 25 | 12 | " | — | 80 | " | 860 | 20 | 30 | 56 | 26 | 11 | 3 |
| 26 | 4 | " | — | 93 | 40 | 840 | 10 | 14 | 45 | 30 | 15 | 10 |
| 27 | 5 | " | — | " | 15 | 880 | 40 | 42 | 60 | 28 | 18 | 23 |
| 28 | 5 | " | — | " | 21 | 920 | 20 | 47 | 49 | 20 | 17 | 25 |
| 29 | 9 | " | — | " | " | 840 | 50 | 45 | 50 | 37 | 13 | 30 |
| 30 | 8 | " | — | " | " | 800 | 7 | 13 | 41 | 23 | 11 | 26 |
| 31 | 1 | 880 | — | 94 | 16 | 740 | 40 | 15 | 50 | 24 | 6 | 18 |
| 32 | 1 | 840 | 40 | 94 | 16 | 790 | 20 | 17 | 30 | 13 | 4 | 11 |
| 33 | 2 | 880 | — | 89 | 29 | 790 | 35 | 25 | 36 | 26 | 5 | 18 |
| 34 | 5 | 870 | — | 92.7 | 16 | 810 | 13 | 16 | 43 | 21 | 10 | 15 |
| 35 | 4 | 890 | 55 | 88 | 21 | 810 | 25 | 24 | 29 | 20 | 8 | 14 |
| 36 | 4 | 840 | 55 | 81 | 29 | 810 | 40 | 28 | 30 | 9 | 1 | 6 |
| 37 | 3 | 810 | 47.5 | 88 | 17 | 850 | 6 | 15 | 24 | 13 | 4 | 8 |
| 38 | 6 | 870 | — | 84 | 17 | 850 | 15 | 29 | 41 | 22 | 4 | 14 |
| 39 | 9 | 850 | 40 | 81 | 26 | 850 | 40 | 36 | 30 | 16 | 2 | 10 |
| 40 | 10 | 870 | — | 87 | 21 | 870 | 4 | 19 | 36 | 23 | 4 | 15 |
| 41 | 7 | 840 | — | 92 | 26 | 870 | 15 | 31 | 41 | 17 | 5 | 12 |
| 42 | 7 | 820 | — | 81 | 29 | 870 | 40 | 40 | 50 | 29 | 9 | 17 |
| 43 | 8 | 830 | 47.5 | 94 | 16 | 900 | 2 | 16 | 30 | 7 | 4 | 2 |
| 44 | 11 | 810 | 40 | 88 | 21 | 900 | 5 | 24 | 28 | 10 | 3 | 5 |
| 45 | 13 | 830 | 47.5 | 81 | 29 | 900 | 10 | 30 | 29 | 23 | 6 | 13 |
| 46 | 12 | 960 | — | 93 | 21 | 900 | 40 | 45 | 45 | 30 | 15 | 20 |

TABLE 13

| Material No. | Alloy No. | Mechanical property after the annealing before press-forming: n value | r value | Elongation (%) | Press-form quality: Shape fix ability | Fitness to die | Crack generation on alloy sheet | Frequency of penetration irregularity | Partial color-phase shift |
|---|---|---|---|---|---|---|---|---|---|
| 22 | 1 | 0.30 | 0.90 | 40.5 | ○ | ○ | No | 0 | Yes |
| 23 | 2 | 0.30 | 0.85 | 38.5 | ○ | ○ | Yes | 0 | No |
| 24 | 6 | 0.30 | 0.90 | 40.0 | ○ | ○ | No | 1 | No |
| 25 | 12 | 0.30 | 0.90 | 40.1 | ○ | ○ | No | 2 | No |
| 26 | 4 | 0.27 | 0.85 | 37.9 | X | ○ | Yes | 0 | —* |
| 27 | 5 | 0.29 | 0.94 | 37.5 | ○ | ○ | Yes | 4 | Yes |
| 28 | 5 | 0.29 | 0.86 | 34.0 | ○ | ○ | Yes | 4 | No |
| 29 | 9 | 0.27 | 0.70 | 35.0 | ○ | ○ | Yes | 0 | Yes |
| 30 | 8 | 0.26 | 0.75 | 37.2 | X | ○ | Yes | 0 | —* |
| 31 | 1 | 0.30 | 0.92 | 42.1 | ○ | ○ | No | 0 | No |
| 32 | 1 | 0.30 | 1.05 | 42.3 | ○ | ○ | No | 0 | No |
| 33 | 2 | 0.32 | 0.91 | 42.0 | ◎ | ○ | No | 0 | No |
| 34 | 5 | 0.30 | 0.94 | 41.8 | ○ | ○ | No | 0 | No |
| 35 | 4 | 0.32 | 0.93 | 42.0 | ○ | ○ | No | 0 | No |
| 36 | 4 | 0.33 | 1.15 | 42.9 | ◎ | ○ | No | 0 | No |
| 37 | 3 | 0.30 | 1.02 | 42.6 | ○ | ○ | No | 0 | No |
| 38 | 6 | 0.33 | 0.92 | 41.8 | ◎ | ○ | No | 0 | No |
| 39 | 9 | 0.34 | 1.00 | 42.6 | ◎ | ○ | No | 0 | No |
| 40 | 10 | 0.31 | 0.92 | 41.6 | ○ | ○ | No | 0 | No |
| 41 | 7 | 0.33 | 0.98 | 42.0 | ◎ | ○ | No | 0 | No |
| 42 | 7 | 0.35 | 0.90 | 42.1 | ◎ | ○ | No | 0 | No |

TABLE 13-continued

| | | Mechanical property after the annealing before press-forming | | | Press-form quality | | | | |
|---|---|---|---|---|---|---|---|---|---|
| Material No. | Alloy No. | n value | r value | Elongation (%) | Shape fix ability | Fitness to die | Crack generation on alloy sheet | Frequency of penetration irregularity | Partial color-phase shift |
| 43 | 8 | 0.31 | 1.20 | 43.3 | ○ | ○ | No | 0 | No |
| 44 | 11 | 0.32 | 1.03 | 43.2 | ○ | ○ | No | 0 | No |
| 45 | 13 | 0.33 | 0.93 | 41.9 | ◎ | ○ | No | 0 | No |
| 46 | 12 | 0.36 | 1.20 | 40.9 | ◎ | ○ | No | 0 | No |

This invention is further described in detail from the technological point of view. This invention provides a means to give a satisfactory press-form quality to a Fe—Ni alloy thin sheet for shadow mask while suppressing the generation of partial color-phase shift by adjusting the chemical composition, austenite grain size and its degree of mixed grain, and crystal orientation within the range specified in this invention.

In concrete terms, the limitation of B and O within a specified range enhances the growth of crystal grains during the annealing before press-forming under the condition which is a characteristic of this invention, and the preparation of austenite grain in a specified range gives a good shape fixability during press-forming, and the limitation of Si and N within a specific range improves the fitness to die during press-forming and suppresses the galling of alloy sheet to die. Also by adjusting the austenite grain size before the annealing before press-forming within an adequate range and by adjusting the Vickers hardness within an adequate range corresponding to the grain size, the growth of grains during the annealing before press-forming is enhanced, and the shape fixability is improved. In addition, by specifying the maximum and minimum size of austenite grains before the annealing before press-forming and by limiting the degree of crystal planes on the surface of thin alloy sheet within a specified range, the generation of crack on alloy sheet during press-forming and the generation of penetration irregularity are prevented and the generation of partial color-phase shift is suppressed.

There is a limitation on the content of Ni, a component of Fe—Ni alloy thin sheet for shadow mask. To prevent such an alloy sheet from color-phase shift, the upper limit of average thermal expansion coefficient of the alloy is approximately $2.0\times10^{-6}$/°C. in a range of 30°–100° C. The value of thermal expansion coefficient depends on the Ni content in the thin alloy sheet. The range of Ni content to satisfy the condition is in a range of 34–38%. Therefore, the Ni content should be specified to 34–38%.

More preferable range of Ni content to decrease the average thermal expansion coefficient is in a range of 35–37%, and most preferably in a range of 35.5–36.5%. When the alloy sheet contains 0.01–6% of cobalt, the preferred Ni content may be in a range of 30–37%.

The element of O which is described before, is an impurity unavoidably enters into the alloy. Increased content of O increases the quantity of non-metallic oxide inclusion in the alloy, which inclusion then suppresses the growth of grains during annealing before press-forming, particularly for the annealing temperature below 800° C. In concrete terms, when the O content exceeds 0.0030%, the inhibition against grain growth is significantly enhanced to fail to achieve grain growth specified in this invention and the press forming performance intended in this invention is not obtained. Therefore, the upper limit of O content is specified to 0.0030%. The lower limit of O content is not necessarily specified, but 0.0001% is preferable from the economy of ingot-making process.

Presence of B improves the hot-working performance of this alloy. However, excess amount of B induces segregation of B to the recrystallized grain boundaries which are formed during the annealing before press-forming, which makes difficult for the grain boundaries to migrate. The phenomenon suppresses the growth of grains and fails to obtain a specified value of 0.2% proof stress after the annealing before press-forming. In particular, under the condition of annealing before press-forming specified in this invention, such an inhibition action to the grain growth is strong and the action does not work uniformly on all grains. Accordingly, the resulted alloy shows a significant degree of mixed grain, an irregularity in elongation of material during press-forming, and results in a penetration irregularity.

When the B content exceeds 0.0010%, the inhibit(on action against grain growth is further enhanced to fail to obtain the press-form quality being aimed at in this invention, and the problem of penetration irregularity occurs. Consequently, the upper limit of B content in this invention is specified to 0.0010%.

Silicon is used as the deoxidizer during ingot-making of the alloy. When the Si content exceeds 0.05%, an oxide film of Si is formed on the surface of alloy during the annealing before press-forming. The oxide film degrades the fitness between die and alloy sheet during press-forming and results in the galling of die by alloy sheet. Consequently, the upper limit of Si content is specified as 0.05%. Less Si content improves the fitness of die and alloy sheet. The lower limit of Si content is not necessarily specified but 0.001% or higher content is preferred from the economy of ingot-making process.

Nitrogen is an element unavoidably enters into the alloy during ingot-making process. Nitrogen content higher than 0.0015% induces the concentration of N on the surface of alloy during the annealing before press-forming. The concentrated N on the surface of alloy degrades the fitness of die and alloy sheet to gall die with the alloy sheet. Consequently, the upper limit of N content is specified as 0.0015%. Although the lower limit of N content is not necessarily defined, 0.0001% or higher content is preferred from the economy of ingot-making process.

To improve the shape fixability and to suppress crack generation on alloy sheet during press-forming, and also to prevent generation of penetration irregularity after press-forming, this invention specifies the conditions of the average austenite grain size, Dav, before the annealing before press-forming within a range of 10.5–15 μm, the condition of the ratio of maximum to minimum austenite grain size (Dmax/Dmin) within a range of 1–15, and the condition of Vickers hardness (Hv) of the alloy sheet within a range of 165–220, and the condition of $[10\times Dav+80 \geqq (Hv) \geqq 10\times Dav+50$.

Under the condition of annealing before press-forming specified in this invention, a value of Dav below 10.5 μm fails to increase the crystal grain size of alloy during the annealing before press-forming and increases the degree of spring-back to degrades the shape fixability, which results in an inadequate state of alloy sheet. On the other hand, a value of Dav exceeding 15 μm inhibits the recrystallization during the annealing before press-forming, which also degrades the shape fixability and results in an inadequate state of the alloy sheet.

Figure 12:
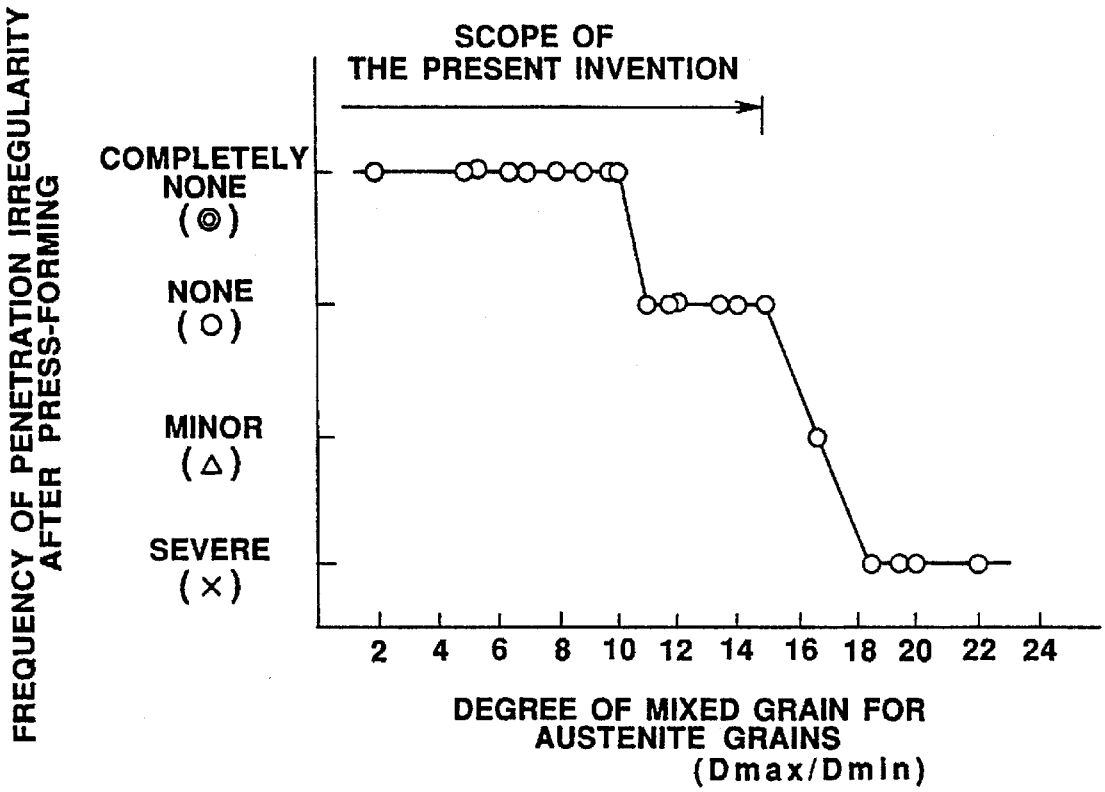
FIG. 12 shows the relation between degree of mixed grain for austenite grains and penetration irregularity after press-forming, being described in the preferred embodiment-3.

As shown in FIG. 12, when the ratio of maximum to minimum size of austenite grains exceeds 15, the size of etched holes becomes non-uniform and generates penetration irregularity, which results in an inadequate state of alloy sheet. Lower degree of mixed grain is more favorable, and the lower limit of the degree is 1. Vickers hardness is defined mainly by the cold-rolling reduction ratio, but the Hv of below 165 does not give sufficient strain to alloy sheet, and give a poor driving force for recrystallization during the annealing before press-forming to inhibit sufficient recrystallization, so the alloy sheet after the annealing before press-forming still remains at a rather hard state to degrade the shape fixability, which is unfavorable. On the other hand, when an alloy sheet is given with excess strain and when the hardness exceeds Hv 220, the driving force for recrystallization occurring during the annealing before press-forming is high, and the frequency of nucleation during the recrystallization becomes too high, which then induces the re-grain formation of crystallized grains after the annealing before press-forming. That is also an unfavorable state.

Regarding the value of Dav, a large value of Dav needs a large strain, and a small value of Dav provides a large number of nucleation sites, so the upper limit of hardness is to be specified.

From the above consideration, to improve the grain growth during the annealing before press-forming, to provide favorable shape fix ability, and to suppress the penetration irregularity, this invention specifies the condition of:

$10.5 \leqq Dav \leqq 15$ μm, $1 \leqq (Dmax/Dmin) \leqq 15$, $165 \leqq Hv \leqq 220$, and $[10\times Dav+80] \geqq Hv \geqq [10\times Dav+50]$.

In addition to the above conditions, to keep the degree of crystal plane on the surface of alloy sheet before the annealing before press-forming within a specified range is important to prevent the generation of crack on alloy sheet during press-forming, to prevent the generation of penetration irregularity after masking, and to suppress the partial color-phase shift. To do this, it is necessary to keep the degree of each crystal plane on the alloy sheet within the range specified in Table 14.

By applying X-ray diffraction method to the surface of alloy sheet, the X-ray diffraction intensity of each diffraction plane of (111), (200), (220), (311), (331), (420), and (422) were measured, from which the degree of each crystal .orientation was determined. For example, the degree of {111} plane was obtained from the relative X-ray intensity ratio on (111) diffraction plane divided by the sum of relative X-ray intensity ratio on each diffraction plane of (111), (200), (220), (311), (331), (420), and (422).

Degree of other planes, {100}, {110}, {311}, {331}, {210}, and {211} were also determined by the similar method as above. The relative X-ray diffraction intensity ratio is defined as the X-ray diffraction intensity measured on each diffraction plane divided by the theoretical X-ray intensity on that diffraction plane. For example, the relative X-ray diffraction intensity ratio of (111) diffraction plane is the X-ray diffraction intensity on (111) diffraction plane divided by the theoretical X-ray diffraction intensity on (111) diffraction plane.

The degree of each plane of {100}, {110}, {210}, and {211} was determined from the relative X-ray diffraction intensity ratio on each (200), (220), (420), and (422) diffraction plane having the equivalent orientation with corresponding plane divided by the sum of the relative X-ray diffraction intensity ratio of the seven diffraction planes, from (111) to (422).

Regarding the reason to limit the condition on each crystal plane, the inventors found that the control of the degree of {211} plane on the thin Invar alloy sheet before the annealing before press-forming suppresses the generation of crack on the alloy sheet during press-forming. When the degree of {211} plane exceeds 20%, crack occurs on the alloy sheet during press-forming.

When the degree of {111}, {311}, {331}, and {210} plane exceeds 14%, 20%, 20%, and 20%, respectively, the hole shape changes during the press-forming and the partial color-phase shift is induced.

Control of the degree of {100} plane and {110} plane is necessary to keep the degree of mixed grain within the range specified in this invention. When the degree of {100} plane exceeds 75% or when the degree of {110} plane exceeds 40%, the degree of mixed grain of the alloy sheet exceeds 15, the recrystallization during the annealing before press-forming does not proceed uniformly, the crystallized grains become a mixed grain state after the annealing before press-forming, and the penetration irregularity occurs.

When the degree of {100} plane becomes less than 5%, the degree of {110} plane exceeds 40%, the degree of mixed grain exceeds 15. When the degree of {110} plane becomes less than 5%, the degree of {100} plane exceeds 75%. Both of these alloy sheets are inadequate owing to the reason given above. From the finding, this invention specifies the degree of {100} plane as 5–75% and the degree of {100} plane as 5–40%.

Figure 13:
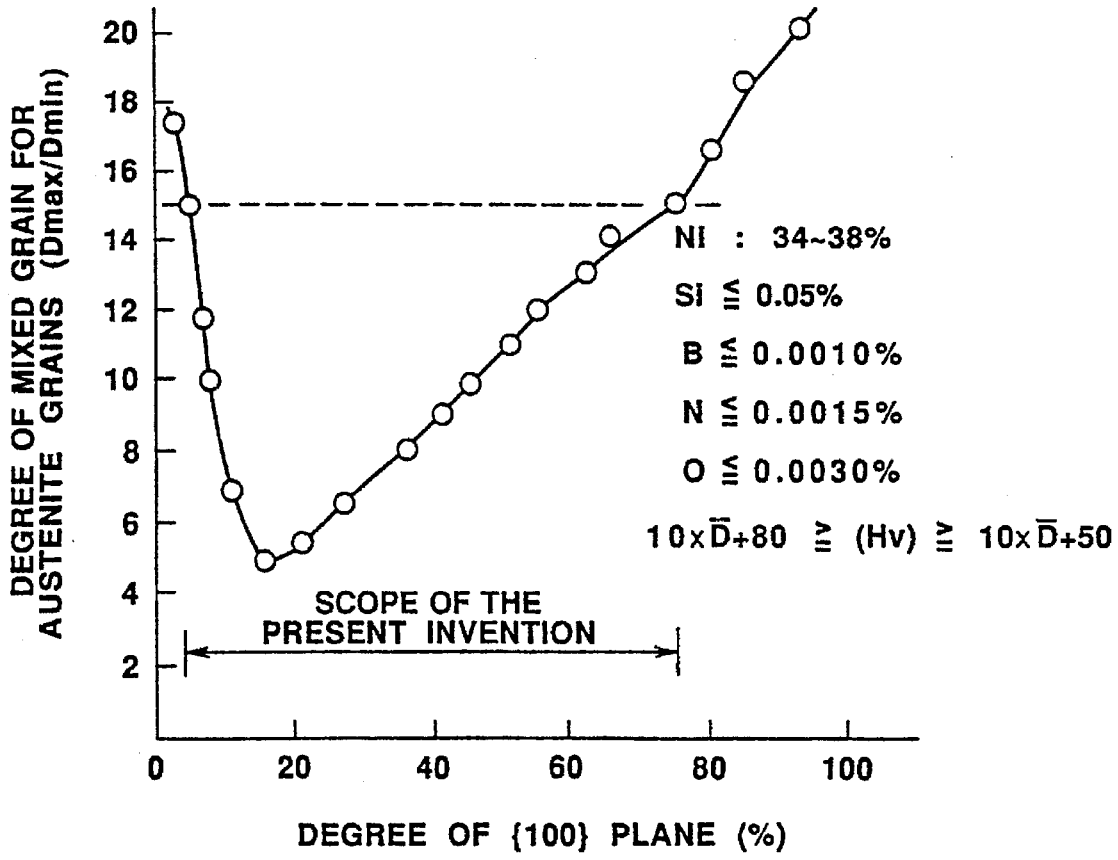
FIG. 13 shows the relation between degree of {100} plane and degree of mixed grain for austenite grains, being described in the preferred embodiment-3.

As shown in FIG. 13, when an alloy sheet having the degree of {100} plane within the range of this invention is adjusted in a range of 8–46%, the degree of mixed grain is further decreased. This adjustment suppresses the generation

TABLE 14

| Crystal plane | {111} | {100} | {110} | {311} | {331} | {210} | {211}) |
|---|---|---|---|---|---|---|---|
| Degree of crystal plane (%) | 14 | 75 | 40 | 20 | 20 | 20 | 20 |

of penetration irregularity more strongly after press-forming, which is a favorable state.

The Invar alloy for shadow mask of this invention specifies the addition of B, O, Si, and N to the Fe—Ni base composition described before. More preferably, such a composition further contains 0.0001–0.0040% of C, 0.001–0.35% of Mn, and 0.001–0.05% of Cr.

To keep either the upper limit or the range of the degree of seven crystal planes, {111}, {100}, {110}, {311}, {331}, {210}, and {211} before the annealing before press-forming at 1.4%, 5–75%, 5–40%, 20%, 20%, 20%, and 20%, respectively, a satisfactory means is to adopt the production conditions which control these seven crystal planes in the cold-rolling and annealing process after the steps of solidification and hot-working on the thin alloy sheet making.

For example, when the alloy of this invention is prepared from the hot-rolled strip starting from ingot or continuously casted slab by slabbing and hot-rolling, the hot-rolled strip is subjected to hot-rolled sheet annealing, cold-rolling, recrystallization annealing, cold-rolling, recrystallization annealing, finish cold-rolling, strain-relief annealing, annealing before press-forming, then blackening treatment. In that case, the homogenizing heat treatment of the slab after slabbing or the slab obtained continuous casting is not favorable. For instance, when the homogenizing heat treatment is carried at 1200° C. or higher temperature and 10 hours or longer period, the degree of crystal plane being aimed at in this invention is not obtained. Also it is necessary to conduct adequate hot-rolled sheet annealing after hot-rolling. In this case, the temperature of hot-rolled sheet annealing is selected within a range of 910°–990° C.

[Embodiment]

This invention is described to a greater detail in the following referring to the embodiment. It will be apparent that this invention is not limited to the embodiment as various changes and modifications can be made therein without departing from the spirit and scope thereof.

(Example 8)

The inventors prepared the alloy ingots of No. 1 through No. 18 having the chemical composition listed on Table 4 by ladle refining. After treating with slabbing, surface defect removing, and hot-rolling at 1100° C. for 3 hours, the hot-rolled sheets were obtained. From these hot-rolled sheets, samples were prepared under the condition given below.

TABLE 15

| Material | Alloy | Chemical composition | | | | | | | | |
|---|---|---|---|---|---|---|---|---|---|---|
| No. | No. | Ni | Si | O | N | B | C | Mn | Cr | H(ppm) |
| 1 | 1 | 35.9 | 0.005 | 0.0010 | 0.0008 | 0.00005 | 0.0013 | 0.25 | 0.01 | 1.0 |
| 2 | 2 | 36.1 | 0.02 | 13 | 10 | 0.0001 | 11 | 0.26 | 2 | 0.2 |
| 3 | 3 | 36.0 | 0.03 | 14 | 11 | 0.0001 | 15 | 0.04 | 2 | 0.8 |
| 4 | 4 | 36.5 | 0.05 | 20 | 15 | 0.0005 | 0.0040 | 0.35 | 2 | 1.0 |
| 5 | 5 | 35.8 | 0.01 | 15 | 10 | 0.0002 | 23 | 0.25 | 5 | 0.9 |
| 6 | 6 | 35.7 | 0.01 | 12 | 9 | 0.0001 | 20 | 0.27 | 1 | 0.9 |
| 7 | 7 | 36.0 | 0.02 | 8 | 7 | 0.0002 | 9 | 0.11 | 3 | 0.7 |
| 8 | 8 | 36.2 | 0.05 | 5 | 5 | 0.0001 | 7 | 0.05 | 2 | 0.9 |
| 9 | 9 | 36.2 | 0.001 | 2 | 2 | 0.0001 | 5 | 0.005 | 1 | 0.6 |
| 10 | 10 | 35.5 | 0.04 | 18 | 11 | 0.0001 | 32 | 0.01 | 1 | 0.6 |
| 11 | 11 | 35.8 | 0.03 | 16 | 12 | 0.0002 | 30 | 0.20 | 2 | 0.3 |
| 12 | 12 | 35.0 | 0.05 | 19 | 15 | 0.0004 | 39 | 0.15 | 3 | 0.2 |
| 13 | 13 | 36.0 | 0.01 | 17 | 12 | 0.0001 | 37 | 0.05 | 4 | 0.5 |
| 14 | 14 | 35.6 | 0.08 | 20 | 14 | 0.0002 | 21 | 0.28 | 3 | 1.1 |
| 15 | 15 | 36.2 | 0.05 | 35 | 12 | 0.0001 | 17 | 0.31 | 4 | 1.1 |
| 16 | 16 | 36.3 | 0.04 | 18 | 20 | 0.0002 | 19 | 0.25 | 3 | 1.3 |
| 17 | 17 | 36.0 | 0.04 | 17 | 15 | 0.0011 | 25 | 0.28 | 4 | 1.2 |
| 18 | 18 | 35.8 | 0.05 | 23 | 16 | 0.0021 | 32 | 0.27 | 4 | 1.3 |

Materials of No. 1 through No. 17 and No. 22 through No. 25 are the alloy sheets of 0.25 mm thickness prepared from the hot-rolled alloy sheets given in Table 16, Table 17, Table 18, and Table 19, by the treatment of hot-rolled sheet annealing at 910°–990° C., followed by two cycles of the cold-rolling with 40% reduction ratio and annealing at 860°–940° C. for 125 sec., then by strain-relief annealing at 530° C. for 30 sec.

TABLE 16

| Material No. | Alloy No. | D: Average austenite grain size before the annealing before press-forming (μm) | Degree of mixed grain for austenite grains before the annealing before press-forming (Dmax/Dmin) | Vickers hardness before the annealing before press-forming (Hv) | 10D + 80 − (Hv) | (Hv) − 10D − 50 |
|---|---|---|---|---|---|---|
| 1 | 1 | 11.8 | 5.0 | 181 | Positive | Positive |
| 2 | 2 | 11.7 | 15.0 | 180 | Positive | Positive |
| 3 | 3 | 11.8 | 6.5 | 175 | Positive | Positive |
| 4 | 4 | 12.6 | 12.5 | 206 | 0 | Positive |
| 5 | 5 | 12.5 | 8.0 | 175 | Positive | 0 |

TABLE 16-continued

| Material No. | Alloy No. | D: Average austenite grain size before the annealing before press-forming (μm) | Degree of mixed grain for austenite grains before the annealing before press-forming (Dmax/Dmin) | Vickers hardness before the annealing before press-forming (Hv) | 10D + 80 − (Hv) | (Hv) − 10D − 50 |
|---|---|---|---|---|---|---|
| 6 | 6 | 12.5 | 11.0 | 100 | Positive | Positive |
| 7 | 7 | 11.1 | 5.4 | 191 | 0 | Positive |
| 8 | 8 | 13.7 | 15.0 | 188 | Positive | Positive |
| 9 | 9 | 11.5 | 12.0 | 166 | Positive | Positive |
| 10 | 10 | 10.5 | 9.0 | 185 | 0 | Positive |
| 11 | 11 | 10.6 | 10.1 | 165 | Positive | Positive |
| 12 | 12 | 14.0 | 11.8 | 219 | Positive | Positive |
| 13 | 13 | 15.0 | 9.8 | 220 | Positive | Positive |
| 14 | 14 | 10.6 | 11.0 | 185 | Positive | Positive |
| 15 | 15 | 8.5 | 19.5 | 175 | Negative | Positive |
| 16 | 16 | 10.5 | 15.0 | 173 | Positive | Positive |
| 17 | 17 | 9.0 | 18.5 | 180 | Negative | Positive |
| 18 | 18 | 10.0 | 20.0 | 183 | Negative | Positive |

Dmax: The maximum austenite grain size in alloy sheet.
Dmin: The minimum austenite grain size in alloy sheet.

TABLE 17

| Material No. | Alloy No. | Degree of crystal plane on the surface of alloy sheet before the annealing before press-forming (%) | | | | | | | Press-form quality | | | | |
|---|---|---|---|---|---|---|---|---|---|---|---|---|---|
| | | {111} | {100} | {110} | {311} | {331} | {210} | {211}) | Shape fix ability[1)] | Fitness to die[2)] | Crack generation on alloy sheet | Frequency of penetration irregularity[3)] | Partial color-phase shift |
| 1 | 1 | 9 | 16 | 24 | 14 | 12 | 13 | 12 | ◎ | ○ | No | ◎ | No |
| 2 | 2 | 2 | 72 | 8 | 3 | 8 | 4 | 3 | ◎ | ○ | No | ○ | No |
| 3 | 3 | 6 | 27 | 30 | 11 | 7 | 11 | 8 | ◎ | ○ | No | ◎ | No |
| 4 | 4 | 3 | 62 | 15 | 6 | 8 | 4 | 2 | ○ | ○ | No | ○ | No |
| 5 | 5 | 7 | 36 | 23 | 12 | 8 | 10 | 4 | ○ | ○ | No | ◎ | No |
| 6 | 6 | 6 | 51 | 17 | 7 | 9 | 5 | 5 | ◎ | ○ | No | ○ | No |
| 7 | 7 | 10 | 21 | 29 | 10 | 10 | 10 | 10 | ○ | ○ | No | ◎ | No |
| 8 | 8 | 4 | 5 | 37 | 17 | 12 | 13 | 12 | ○ | ○ | No | ○ | No |
| 9 | 9 | 4 | 55 | 15 | 7 | 8 | 6 | 5 | ○ | ○ | No | ○ | No |
| 10 | 10 | 6 | 41 | 22 | 9 | 10 | 7 | 5 | ○ | ○ | No | ◎ | No |
| 11 | 11 | 10 | 8 | 31 | 15 | 11 | 12 | 13 | ○ | ○ | No | ◎ | No |
| 12 | 12 | 9 | 7 | 35 | 16 | 12 | 10 | 11 | ○ | ○ | No | ○ | No |
| 13 | 13 | 7 | 45 | 18 | 8 | 9 | 6 | 5 | ○ | ○ | No | ◎ | " |
| 14 | 14 | 2 | 65 | 12 | 6 | 8 | 5 | 2 | ○ | X | No | ○ | No |
| 15 | 15 | 2 | 90 | 3 | 1 | 2 | 1 | 1 | X | ○ | Yes | X | —* |
| 16 | 16 | 3 | 73 | 6 | 4 | 7 | 4 | 3 | ○ | X | No | ○ | No |
| 17 | 17 | 2 | 85 | 4 | 2 | 4 | 2 | 1 | X | ○ | Yes | X | —* |
| 18 | 18 | 1 | 93 | 0 | 1 | 3 | 1 | 1 | X | ○ | Yes | X | —* |

[1)]Evaluation scheme: Very good ◎, Good ○, Rather poor X
[2)]Evaluation scheme: Good (without ironing mark) ○, Rather poor (with minor ironing mark) Δ, Bad (lots of ironing marks) X, ⊗ Could not evaluate
[3)]Evaluation scheme: Completely non ◎, None ○, Slightly existing Δ, Existing X

TABLE 18

| Material No. | Alloy No. | D: Average austenite grain size before the annealing before press-forming (μm) | Degree of mixed grain for austenite grains before the annealing before press-forming (Dmax/Dmin) | Vickers hardness before the annealing before press-forming (Hv) | 10D + 80 − (Hv) | (Hv) − 10D − 50 |
|---|---|---|---|---|---|---|
| 19 | 1 | 15.5 | 14.0 | 205 | Positive | Positive |
| 20 | 1 | 9.5 | 14.5 | 170 | Positive | Positive |
| 21 | 2 | 10.5 | 22.0 | 180 | Positive | Positive |
| 22 | 5 | 11.0 | 14.0 | 225 | Negative | Positive |
| 23 | 2 | 10.8 | 13.5 | 163 | Positive | Positive |
| 24 | 6 | 11.9 | 15.0 | 200 | Negative | Positive |
| 25 | 6 | 13.3 | 12.0 | 175 | Positive | Negative |
| 26 | 4 | 10.9 | 16.7 | 170 | Positive | Positive |
| 27 | 3 | 11.5 | 6.0 | 185 | Positive | Positive |
| 28 | 4 | 10.8 | 6.0 | 167 | Positive | Positive |
| 29 | 7 | 11.2 | 13.0 | 190 | Positive | Positive |

Dmax: The maximum austenite grain size in alloy sheet.
Dmin: The minimum austenite grain size in alloy sheet.

TABLE 19

| Material No. | Alloy No. | Degree of crystal plane on the surface of alloy sheet before the annealing before press-forming (%) {111} | {100} | {110} | {311} | {331} | {210} | {211}) | Shape fix ability[1)] | Fitness to die[2)] | Crack generation on alloy sheet | Frequency of penetration irregularity[3)] | Partial color-phase shift |
|---|---|---|---|---|---|---|---|---|---|---|---|---|---|
| 19 | 1 | 3 | 70 | 10 | 2 | 9 | 4 | 2 | X | ○ | No | ○ | —* |
| 20 | 1 | 3 | 73 | 6 | 3 | 7 | 4 | 4 | X | ○ | No | ○ | —* |
| 21 | 2 | 0 | 97 | 3 | 0 | 0 | 0 | 0 | ○ | ○ | No | X | —* |
| 22 | 5 | 2 | 71 | 9 | 4 | 7 | 5 | 2 | X | ○ | No | ○ | —* |
| 23 | 2 | 1 | 65 | 10 | 7 | 9 | 7 | 1 | X | ○ | No | ○ | —* |
| 24 | 6 | 12 | 5 | 40 | 10 | 11 | 11 | 11 | X | ○ | No | ○ | —* |
| 25 | 6 | 11 | 7 | 37 | 13 | 9 | 10 | 13 | X | ○ | No | ○ | —* |
| 26 | 4 | 13 | 3 | 5 | 9 | 9 | 11 | 10 | ○ | ○ | No | Δ | —* |
| 27 | 3 | 16 | 15 | 7 | 22 | 15 | 13 | 12 | ○ | ○ | No | ○ | Yes |
| 28 | 4 | 8 | 24 | 32 | 4 | 3 | 3 | 26 | ○ | ○ | No | ○ | No |
| 29 | 7 | 14 | 6 | 15 | 11 | 21 | 23 | 10 | ○ | ○ | No | ○ | Yes |

[1)]Evaluation scheme: Very good ⊙, Good ○, Rather poor X
[2)]Evaluation scheme: Good (without ironing mark) ○, Rather poor (with minor ironing mark) Δ, Bad (lots of ironing marks) X, ⨯ Could not evaluate
[3)]Evaluation scheme: Completely non ⊙, None ○, Slightly existing Δ, Existing X Materials of No. 18 and No. 21 are the alloy sheets of 0.25 mm thickness prepared from the hot-rolled strips of No. 18 and No. 2, respectively, through the cold-rolling (92.5%), annealing (850° C.×1 min.), finish cold-rolling (15%), and strain-relief annealing (530° C.×3 sec.).

Material of No. 19 is the alloy sheet of 0.25 mm thickness prepared from the hot-rolled strip of No. 1 through the hot-rolled sheet annealing (950° C.), cold-rolling (4%), annealing (950° C.×180 sec.), cold-rolling (40%), annealing (950° C.×180 sec.), finish cold-rolling (15%), and strain-relief annealing (530° C.×30 sec.).

Material of No. 20 is the alloy sheet of 0.25 mm thickness prepared from the hot-rolled strip of No. 1 through the hot-rolled sheet annealing (950° C.), cold-rolling, annealing (800° C.×30 sec.), cold-rolling, annealing (800° C.×30 sec.), finish cold-rolling, and strain-relief annealing (530° C.×30 sec.).

Materials of No. 26 through No. 29 are the alloy sheets of 0,25 mm thickness prepared from the hot-rolled strips of No. 4, No. 3, No. 4, and No. 7, respectively, through the cold-rolling, annealing (860°–940° C.×125 sec.), cold-rolling, annealing (860°–940° C.×125 sec.), finish cold-rolling, and strain-relief annealing (530° C.×30 sec.). All the hot-rolled strips employed showed sufficient recrystallization after annealing.

Alloy sheets of No. 1 through No. 29 prepared by the treatment described above were etched and formed into flat masks. Those flat masks were treated by annealing before press-forming at 770° C. for 45 min. followed by press-forming. The shape fixability, fitness to die, crack generation on material, and penetration irregularity of these press-formed materials were determined using the conditions specified in Table 16, Table 17, Table 18, and Table 19. Partial color-phase shift was measured after blackening the press-formed shadow masks, assembling them into cathode ray tubes, and irradiating electron beam on the surface thereof.

The average austenite grain size, degree of mixed grain for austenite grains, Vickers hardness, and degree of planes {111 }, {100}, {110}, {311}, {331}, {210}, and {211} were determined before the annealing before press-forming.

As understood from the above description and Table 16 and Table 17, the materials of No. 1 through No. 13 have excellent press-form quality without giving partial color-phase shift, which materials have the composition, degree of crystal planes {111}, {100}, {110}, {311}, {331}, {210}, and {211}, average austenite grain size before the annealing before press-forming, degree of mixed grain for austenite grain, Vickers hardness within the range specified in this invention, and which materials satisfy the condition of $$10\ Dav+80 \geqq Hv \geqq 10-Dav+50.$$

Materials of No. 14 and No. 16 give Si content and N content above the upper limit of this invention, respectively, which induces problem of fitness to die. Material No. 15 gives O content above the upper limit of this invention and gives average austenite grain size (referred to simply as "average grain size" hereafter) before the annealing before press-forming below the lower limit of this invention, and is inferior in the shape fixability at the press-forming to generate crack on alloy sheet. Material No. 15 also gives degree of mixed grain for austenite grain (referred to simply as "degree of mixed grain" hereafter) above the upper limit of this invention, along with the generation of penetration irregularity.

Materials of No. 17 and No. 18 give B content or both B content and O content above the upper limit of this invention, give the average grain size at or below 10.5 μm, give poor shape fixability at press-forming, generate crack on alloy sheet, give the degree of mixed grain above the upper limit of this invention, also generate penetration irregularity. In particular, material No. 18 was not treated by hot-rolled sheet annealing and was subjected to cold-rolling (92.5%), annealing (850° C.×1 min.), and finish cold-rolling (15% reduction ratio), which treatment conformed to the technology described in JP-A-H3-267320. These materials, however, do not satisfy the limitation of the degree of plane and {100} plane in this invention, particularly the degree of mixed grain becomes very high.

Material No. 21 was prepared in a similar manner with material No. 18. Material No. 21 does not satisfy the limit of the degree of {100} plane and {110} plane of this invention, gives a large value of degree of mixed grain, and generates penetration irregularity. Thus, even an alloy having composition within the range specified in this invention, it can not give the effect of this invention unless it is treated by hot-rolled sheet annealing and succeeding cold-rolling and annealing under the condition specified in this invention.

Materials of No. 19 and No. 20 were prepared by annealing after the cold-rolling under the condition of 950° C.×180 sec. and 800° C.×30 sec., respectively, they give average grain size above the upper limit and below the lower limit of this invention, respectively, and both of them are inferior in shape fixability.

Materials of No. 26 through No. 29 were not treated by hot-rolled sheet annealing, and were treated by the cold-rolling and annealing under the condition specified in this invention. Material No. 26, however, does not satisfy the limit of degree of {110} plane of this invention, gives degree of mixed grain above the upper limit of this invention, and generates penetration irregularity. Material No. 28 gives degree of {211} plane above the upper limit of this invention and generates crack on alloy sheet. Materials No. 27 and No. 29 give degree of {111} plane and {311} plane, and degree of {331} plane and {210} plane above the upper limit of this invention, respectively. The two materials generate partial color-phase shift.

Materials of No. 22 through No. 25 show the values of Hv above the upper limit, Hv below the lower limit, 10 Dav+80<Hv, and Hv<10 Dav+50, respectively, and they are inferior in shape fixability.

As clearly described above, a thin Fe—Ni alloy sheet for shadow mask having excellent press-form quality and screen quality is obtained by keeping the composition, degree of planes {111}, {100}, {110}, {311}, {331}, {210}, and {211}, average grain size, and degree of mixed grain within the range specified in this invention.

Furthermore, the alloy sheets of this invention described above provide favorable etching quality and press-forming quality even the annealing before press-forming is applied before etching. Consequently, this invention provides a thin Fe—Ni Invar alloy sheet for shadow mask which can eliminate the annealing before press-forming at cathode ray tube manufacturers.

As detailed above, this invention provides a thin Fe—Ni Invar alloy sheet for shadow mask which has excellent press-form quality including excellent shape fixability at press-forming, good fitness to die and which suppresses generation of crack on alloy sheet, suppresses generation of penetration irregularity, and which further gives excellent screen quality such as suppressing color-phase shift. Thus, this invention provides significant usefulness to industry with its useful effects.

The above described alloy sheets of this invention offer favorable etching quality and press-form quality even if they are treated by annealing before press-forming before the etching, which provides a thin Fe—Ni Invar alloy sheet for shadow mask that allows for the cathode ray tube manufacturers to eliminate the annealing before press-forming. Thus, also in this respect, this invention provides significant usefulness to industry with its useful effect.

What is claimed is:

1. An annealed thin Fe—Ni alloy sheet for forming a shadow mask by press-forming the annealed thin Fe—Ni alloy sheet, the annealed thin Fe—Ni alloy sheet being of an alloy consisting essentially of Ni in an amount of 34 to 38 wt. % Si in an amount of 0.05 wt % or less, B in an amount of 0.00005 to 0.0005 wt. %, O in an amount of 0.002 wt. % or less and N in an amount of 0.0015 wt. % or less, and optionally C, Mn and Cr, with the balance being Fe and inevitable impurities; the annealed thin Fe—Ni alloy sheet having the following properties:

(i) an average austenite grain size D of 15 to 45 μm;

(ii) the degree of mixed grain for austenite grains being 50% or less, said degree of mixed grain for austenite grains being represented by the following equation:

$$(|0.5\times Dmax-D|/D)\times 100\ (\%),$$

wherein Dmax is the maximum austenite crystal grain size;

(iii) the degree of the {331} plane being 7% to 35%, (iv) the degree of the {210} plane being 1% to 16% and (v) the degree of the {211} plane being 2% to 20%.

2. The annealed thin alloy sheet of claim 1, wherein said Ni ranges from 35 to 37 wt. %, said Si from 0.001 to 0.05 wt. %, said O from 0.0001 to 0.002 wt. % and N from 0.0001 to 0.0015 wt. %.

3. The annealed thin alloy sheet of claim 1, wherein said degree of mixed grain for austenite grains is 40% or less.

4. The annealed thin alloy sheet of claim 1, produced by (a) hot-rolling a slab of said alloy into a hot-rolled strip, (b) annealing the hot-rolled strip at 810° to 890° C., (c) cold-rolling the annealed hot-rolled strip into a cold rolled strip, (d) conducting a recrystallization annealing of the annealed cold-rolled strip, (e) finish cold-rolling the recrystillization annealed strip from step (d), (f) strain relief annealing of the finish cold-rolled strip and (g) annealing the finish cold-rolled strip from step (f) at 740° to 900° C. for 2 to 40 minutes.

5. The annealed thin alloy sheet of claim 1, wherein said Ni is in an amount of 35.5 to 36.6 wt. %.

6. The annealed thin alloy sheet of claim 1, further containing 0.0001 to 0.004 wt. % C.

7. The annealed thin alloy sheet of claim 1, further containing 0.001 to 0.35 wt. % Mn.

8. The annealed thin alloy sheet of claim 1, further containing 0.001 to 0.05 wt. % Cr.

9. The annealed thin alloy sheet of claim 1, further containing 0.0001 to 0.004 wt. % C, 0.001 to 0.35 wt. % Mn and 0.001 to 0.05 wt. % Cr.

* * * * *